US010074336B2

(12) United States Patent
Takata et al.

(10) Patent No.: US 10,074,336 B2
(45) Date of Patent: Sep. 11, 2018

(54) VOLTAGE TRANSMISSION CIRCUIT, VOLTAGE TRANSMITTING CIRCUIT AND VOLTAGE RECEIVING CIRCUIT

(71) Applicant: Synaptics Japan GK, Tokyo (JP)

(72) Inventors: Masashi Takata, Tokyo (JP); Shigeki Ueda, Tokyo (JP); Norihiro Enomoto, Tokyo (JP)

(73) Assignee: Synaptics Japan GK, Nakano, Tokyo (JP)

( * ) Notice: Subject to any disclaimer, the term of this patent is extended or adjusted under 35 U.S.C. 154(b) by 198 days.

(21) Appl. No.: 14/747,338

(22) Filed: Jun. 23, 2015

(65) Prior Publication Data

US 2016/0012794 A1 Jan. 14, 2016

(30) Foreign Application Priority Data

Jul. 11, 2014 (JP) ..... 2014-143186

(51) Int. Cl.
*G09G 3/36* (2006.01)

(52) U.S. Cl.
CPC ..... *G09G 3/3696* (2013.01); *G09G 3/3685* (2013.01); *G09G 2310/027* (2013.01); *G09G 2310/0297* (2013.01); *G09G 2370/08* (2013.01)

(58) Field of Classification Search
CPC ..... G09G 3/3696; G09G 3/36; G09G 2320/0673; G09G 3/20; G09G 2320/0693;

(Continued)

(56) References Cited

U.S. PATENT DOCUMENTS

2002/0044142 A1 4/2002 Fukuda
2004/0125067 A1* 7/2004 Kim ..... G09G 3/3614 345/98

(Continued)

FOREIGN PATENT DOCUMENTS

JP 2006292848 A 10/2006
JP 2011138008 A 7/2011

OTHER PUBLICATIONS

JP Application No. 2014-143186, Office Action dated May 9, 2018, consists of 4 pages with English Translation.

*Primary Examiner* — Robert Michaud
(74) *Attorney, Agent, or Firm* — Patterson + Sheridan, LLP

(57) ABSTRACT

The voltage transmission circuit includes: a multiplexer for transmitting positive and negative voltages ranging +VDD to −VDD selectively; and a demultiplexer for receiving the positive and negative voltages and output them at positive and negative outputs. The voltage transmission circuit is arranged by use of elements each having a withstand voltage of which the absolute value is not 2|VDD|, but |VDD|. While transmitting positive voltages, the multiplexer is configured not to be applied by negative voltages, the multiplexer and demultiplexer are controlled by signals each having a potential of 0 V to +VDD, and the demultiplexer outputs the positive voltages at the positive output. While transmitting negative voltages, the multiplexer is configured not to be applied by positive voltages, the multiplexer and the demultiplexer are controlled by signals each having a potential of −VDD to 0 V, and the demultiplexer outputs the negative voltages at the negative output.

26 Claims, 12 Drawing Sheets

(58) Field of Classification Search
CPC ..... G09G 2310/0221; G09G 3/3685; G09G 2310/027
See application file for complete search history.

(56) References Cited

U.S. PATENT DOCUMENTS

| | | | | |
|---|---|---|---|---|
| 2010/0013869 | A1 | 1/2010 | Matsumoto | |
| 2011/0122056 | A1* | 5/2011 | Chia | G09G 3/3696 345/100 |
| 2015/0109348 | A1* | 4/2015 | Hikichi | G09G 3/20 345/690 |

* cited by examiner

Fig.7

| Phase | MUX STATE OF OUTPUT | GAMMA _OUT | DEMUX State of accepting input |
|---|---|---|---|
| 1 | Outputting positive gradation voltages<br>SWP1_M=ON<br>SWP2_M=ON<br>SWN1_M=OFF<br>SWN2_M=OFF | Positive gradation voltage | Accepting input of positive gradation voltages<br>SWP1_S=ON<br>SWP2_S=ON<br>SWN1_S=ON<br>SWN2_S=OFF |
| 2 | Outputting AGND<br>SWP1_M=OFF<br>SWP2_M=ON<br>SWN1_M=OFF<br>SWN2_M=OFF | AGND | Being stopped from accepting the input<br>SWP1_S=ON<br>SWP2_S=OFF<br>SWN1_S=ON<br>SWN2_S=OFF |
| 3 | Being stopped from outputting<br>SWP1_M=OFF<br>SWP2_M=OFF<br>SWN1_M=OFF<br>SWN2_M=OFF | Hi-Z | Being stopped from accepting the input<br>SWP1_S=ON<br>SWP2_S=OFF<br>SWN1_S=ON<br>SWN2_S=OFF |
| 4 | Outputting AGND<br>SWP1_M=OFF<br>SWP2_M=OFF<br>SWN1_M=OFF<br>SWN2_M=ON | AGND | Being stopped from accepting the input<br>SWP1_S=ON<br>SWP2_S=OFF<br>SWN1_S=ON<br>SWN2_S=OFF |
| 5 | Outputting negative gradation voltages<br>SWP1_M=OFF<br>SWP2_M=OFF<br>SWN1_M=ON<br>SWN2_M=ON | Negative gradation voltage | Accepting input of negative gradation voltages<br>SWP1_S=ON<br>SWP2_S=OFF<br>SWN1_S=ON<br>SWN2_S=ON |
| 6 (=4) | Outputting AGND | AGND | Being stopped from accepting the input |
| 7 (=3) | Being stopped from outputting | Hi-Z | Being stopped from accepting the input |
| 8 (=2) | Outputting AGND | AGND | Being stopped from accepting the input |
| 9 (=1) | Outputting positive gradation voltages | Positive gradation voltage | Accepting input of positive gradation voltages |
| ⋮ | ⋮ | ⋮ | ⋮ |

SEQUENCE FOR TRANSMITTING GRADATION VOLTAGES

SEQUENCE FOR AVERTING THE WITHSTAND VOLTAGE VIOLATION

SEQUENCE FOR AVERTING THE WITHSTAND VOLTAGE VIOLATION

Fig.8

| Phase | MUX STATE OF OUTPUT | GAMMA_OUT | DEMUX State of accepting input | |
|---|---|---|---|---|
| 1 | Outputting positive gradation voltages<br>SWP1_M=ON<br>SWP2_M=ON<br>SWN1_M=OFF<br>SWN2_M=OFF | Positive gradation voltage | Accepting input of positive gradation voltages<br>SWP1_S=ON<br>SWP2_S=ON<br>SWN1_S=ON<br>SWN2_S=OFF | SEQUENCE FOR TRANSMITTING GRADATION VOLTAGES |
| 2 | Outputting AGND<br>SWP1_M=OFF<br>SWP2_M=ON<br>SWN1_M=OFF<br>SWN2_M=OFF | AGND | Being stopped from accepting the input<br>SWP1_S=ON<br>SWP2_S=OFF<br>SWN1_S=ON<br>SWN2_S=OFF | SEQUENCE FOR TRANSMITTING GRADATION VOLTAGES; SEQUENCE FOR AVERTING THE WITHSTAND VOLTAGE VIOLATION |
| 3 | Being stopped from outputting<br>SWP1_M=OFF<br>SWP2_M=OFF<br>SWN1_M=OFF<br>SWN2_M=OFF | Hi-Z | Being stopped from accepting the input<br>SWP1_S=ON<br>SWP2_S=OFF<br>SWN1_S=ON<br>SWN2_S=OFF | SEQUENCE FOR TRANSMITTING GRADATION VOLTAGES; SEQUENCE FOR AVERTING THE WITHSTAND VOLTAGE VIOLATION |
| 4 | Outputting negative gradation voltages<br>SWP1_M=OFF<br>SWP2_M=OFF<br>SWN1_M=ON<br>SWN2_M=ON | Negative gradation voltage | Accepting input of negative gradation voltages<br>SWP1_S=ON<br>SWP2_S=OFF<br>SWN1_S=ON<br>SWN2_S=ON | SEQUENCE FOR TRANSMITTING GRADATION VOLTAGES; SEQUENCE FOR AVERTING THE WITHSTAND VOLTAGE VIOLATION |
| 5 (=2) | Outputting AGND | AGND | Being stopped from accepting the input | SEQUENCE FOR AVERTING THE WITHSTAND VOLTAGE VIOLATION |
| 6 (=3) | Being stopped from outputting | Hi-Z | Being stopped from accepting the input | SEQUENCE FOR AVERTING THE WITHSTAND VOLTAGE VIOLATION |
| 7 (=1) | Outputting positive gradation voltages | Positive gradation voltage | Accepting input of positive gradation voltages | |
| ⋮ | ⋮ | ⋮ | ⋮ | |

VOLTAGE TRANSMISSION CIRCUIT, VOLTAGE TRANSMITTING CIRCUIT AND VOLTAGE RECEIVING CIRCUIT

CROSS-REFERENCE TO RELATED APPLICATIONS

The Present application claims priority from Japanese application JP 2014-143186 filed on Jul. 11, 2014, the content of which is hereby incorporated by reference into this application.

BACKGROUND

The present invention relates to a voltage transmission circuit, a voltage transmitting circuit, and a voltage receiving circuit. Particularly, it can be preferably utilized for a voltage transmission circuit which uses an element with a relatively low withstand voltage to transmit voltages of positive and negative polarities.

Various systems arranged so that ICs (Integrated Circuits) or LSIs (large Scale Integrated circuits) share a common reference voltage have been proposed and put to practical use. In such a system adopted for e.g. a liquid crystal display (LCD: Liquid Crystal Display) or an organic EL (Electro-Luminescence) display with display panels' upsizing and the progress toward higher definition, the display driver is composed of ICs, and display driving is performed for each region of a display panel to be connected thereto. The display panel includes scan lines (gate lines), data lines (source lines) orthogonal thereto, and pixel cells each disposed at a point where the scan and data lines intersect each other. Through data lines (source lines), the display driver applies voltages, corresponding to a brightness to display at, to pixel cells connected to a line selected by the scan line (gate line) (or injects corresponding charges into the pixel cells). In a display panel having a number of pixels increased in a line direction or an upsized screen, a display driver is composed of ICs, which are connected to the data lines (source lines) in units of a number of data lines (source lines) and controlled to perform the display driving in parallel. In this case, pixels allocated to one line are driven by different display driver ICs and therefore, the continuity of displayed brightness becomes significant. The continuity of brightness is maintained by making arrangement so that display driver ICs share a common reference voltage (gradation reference voltage).

The Japanese Unexamined Patent Application Publication No. JP-A-2010-26138 discloses a technique for preventing the worsening of the quality of display by a liquid crystal display which drives a display region while operating drive circuit parts (display drivers) in cooperation. According to the technique, one drive circuit part produces a gradation reference voltage, based on which the other drive circuit parts produce gradation reference voltages. Incidentally, the gradation reference voltage described herein refers to a voltage for producing output voltages to be output from the drive circuit parts to the display panel, which is used as reference when producing gradation voltages. The output voltages of the drive circuit parts are produced from the same gradation reference voltage and therefore, the variation thereof can be suppressed.

The International Publication No. WO 01/057839 discloses a technique for preventing the worsening of the display quality by suppressing, in a display having a display driver of a master mode and a display driver of a slave mode, the drop in source voltage between the display drivers of master and slave modes. In WO 01/057839, gradation voltages are supplied from the display driver of the master mode to the display driver of the slave mode. The reduction in output impedance and the rise in input impedance are enabled by providing voltage follower circuits on transmission and reception sides respectively. Therefore, the gradation voltages suffer from almost no voltage drop in their transmission routes. As a result, in an image screen of a display, the display quality can be prevented from being worsened by deterring the deviation in bias and block unevenness (see p. 14 of WO 01/057839).

SUMMARY

In one embodiment of the present disclosure includes a voltage transmission circuit that includes a multiplexer and demultiplexer. The voltage transmission circuit selectively transmits positive voltages higher than a ground potential from the multiplexer to a positive output of the demultiplexer, and negative voltages lower than the ground potential from the multiplexer to a negative output of the demultiplexer. The voltage transmission circuit also includes a positive power source configured to output a first reference voltage higher than the ground potential and a negative power source configured to output a second reference voltage lower than the ground potential. While transmitting the positive voltages, the multiplexer is configured to receive the input of the positive voltages, but is blocked from receiving the input of the negative voltages, and is controlled by multiplexer-control signals comprising voltage potentials within a range of the ground potential to the first reference voltage to transmit the positive voltages to the demultiplexer. Moreover, the demultiplexer is coupled to demultiplexer-control signals comprising voltage potentials within a range of the ground potential to the first reference voltage, wherein the demultiplexer is configured to output the positive voltages transmitted from the positive output, and output the ground potential from the negative output. While transmitting the negative voltages, the multiplexer is configured to receive the input of the negative voltages, but is blocked from receiving the input of the positive voltages, and is controlled by multiplexer-control signals comprising voltage potentials within a range of the ground potential to the second reference voltage, whereby the negative voltages are transmitted to the demultiplexer. Moreover, the voltage potentials of the demultiplexer-control signals are within a range of the ground potential to the second reference voltage, wherein the demultiplexer is configured to output the negative voltages transmitted thereto from the negative output, and output the ground potential from the positive output.

Another embodiment presented herein is a voltage transmitting circuit that includes a multiplexer configured to select transmission voltages from at least one positive voltage higher than a ground potential, and at least one negative voltage lower than the ground potential, and send the selected transmission voltages to a voltage receiving circuit. The voltage transmitting circuit includes a positive power source configured to output a first reference voltage higher than the ground potential and a negative power source configured to output a second reference voltage lower than the ground potential. While sending the positive voltages as the transmission voltages, the multiplexer is configured to receive the input of the positive voltages, but is blocked from receiving input of the negative voltages, and is controlled by multiplexer-control signals comprising voltage potentials within a range of the ground potential to the first reference voltage to send the positive voltage as the transmission voltages. While sending the negative voltages as the transmission voltages, the multiplexer is configured to receive the input of the negative voltages, but is blocked from receiving the input of the positive voltages, and is controlled by multiplexer-control signals comprising voltage potentials within a range of the ground potential to the second reference voltage to send the negative voltage as the transmission voltages.

Another embodiment of the present disclosure is a voltage receiving circuit operable to receive a transmission voltage transmitted from a voltage transmitting circuit. The a voltage receiving circuit includes a demultiplexer comprising a positive output and a negative output, a positive power source configured to output a first reference voltage higher than a ground potential, and a negative power source configured to output a second reference voltage lower than the ground potential. On condition that the voltage receiving circuit receives, as transmission voltages, at least one positive voltage higher than the ground potential, the demultiplexer is controlled by demultiplexer-control signals comprising voltage potentials within a range of the ground potential to the first reference voltage, thereby outputting the positive voltage transmitted from the positive output, and the ground potential from the negative output. On condition that the voltage receiving circuit receives, as transmission voltages, at least one negative voltage lower than the ground potential, the demultiplexer is controlled by demultiplexer-control signals comprising voltage potentials within a range of the ground potential to the second reference voltage, thereby outputting the negative voltage transmitted thereto from the negative output, and the ground potential from the positive output.

BRIEF DESCRIPTION OF THE DRAWINGS

FIG. 7 is an explanatory diagram showing an example of the transmission sequence in the voltage transmission circuit of FIG. 6;

FIG. 8 is an explanatory diagram showing another example of the transmission sequence in the voltage transmission circuit of FIG. 6;

DETAILED DESCRIPTION

Figure 1:
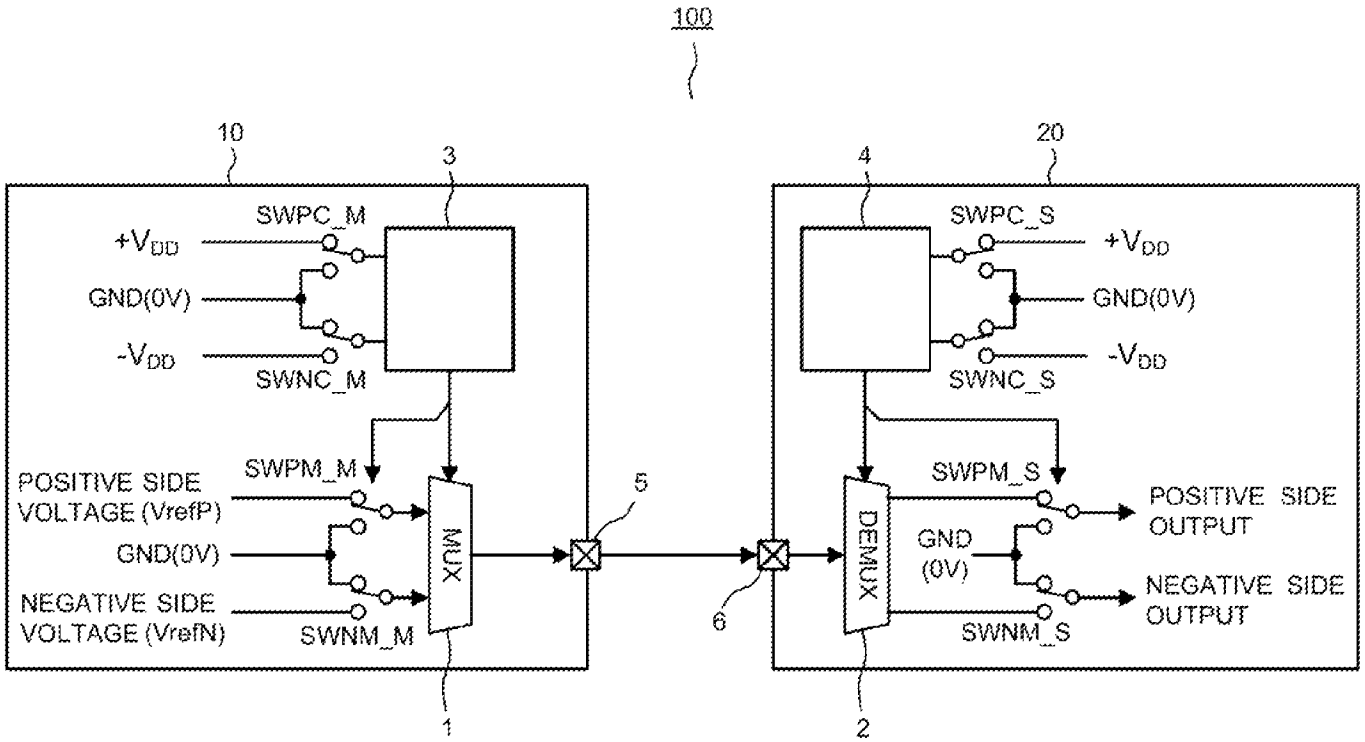
FIG. 1 is a block diagram showing an example of the basic configuration of a voltage transmission circuit according to the invention.

In the display disclosed in JP-A-2010-26138, the exchange of only a single gradation reference voltage is performed between drive circuit parts (display drivers), thereby attempting to reduce the variation in output voltage between the drive circuit parts. The gradation reference voltage is a voltage used as reference when producing gradation voltages; one analog signal, namely a reference potential at one point is just shared by drive circuit parts. The gradation voltages are produced by the respective drive circuit parts based on the gradation reference voltages thus shared. As described in Paragraphs [0143] to [0155] of JP-A-2010-26138 with reference to FIGS. 9A to 9C, each drive circuit part performs a correction to make an output having a predetermined gamma characteristic by performing the inclination adjustment and the amplitude adjustment. Even in the case of making arrangement to share only the gradation reference voltage, as long as there is any variation between the gamma correction circuits, a variation in output voltage can be caused between the drive circuit parts.

On the other hand, in the display disclosed by WO 01/057839, gradation voltages are supplied from the master display driver to the slave display driver, whereby the gradation voltages can be all arranged to be identical to corresponding ones. However, the display like this has the problem of the increase in the chip area and the number of terminals, resulting in the rise in cost in case that the display drivers are materialized by ICs. This is because gradation voltages must be transmitted. In addition, there is the problem that wiring lines on the substrate of the display panel are increased.

In Japanese Patent Application No. 2013-217242, a display driver for a display transmits gradation reference voltages of more than one gradation between display driver ICs. The display driver has a multiplexer provided in a display driver IC on the transmission side, and a demultiplexer provided in a display driver IC on the reception side, and sequentially transmits gradation reference voltages of more than one gradation.

In general, two sets of gradation reference voltages, i.e. one set on the positive side and the other set on the negative side are utilized in a liquid crystal display. The reason for this is that pixel capacitances need inverted for the purpose of preventing the burn-in of a liquid crystal panel. The gradation reference voltages range 0 to 6 V on the positive side, and 0 to −6 V on the negative side, for example. On condition that the display driver IC on the transmission side is provided with a multiplexer and the display driver IC on the reception side is provided with a demultiplexer, gradation reference voltages of more than one gradation are transmitted in turn, in which the gradation reference voltages ranging −6 to +6 V are exchanged between the multiplexer on the transmission side and the multiplexer on the reception side in the above display drivers. On this account, the following fact has been found. That is, the multiplexer on the transmission side and the demultiplexer on the reception side is constituted usually by elements each having a withstand voltage as large as a dozen volts which represents a margin plus 12 V equal to the difference in potential between −6 to +6 V.

In general, display driver ICs require elements each having a withstand voltage as large as 5 or 3 V(middle withstand voltage) for interface with a host processor; in addition, elements each having a lower withstand voltage are integrated in the internal circuit because it can work on a lower source voltage. It is also found that the following problems are posed in case that an element having a withstand voltage as high as a dozen volts or larger is further integrated in the display driver IC like this: it is required to widen a space (or distance) between wells or diffusion layers forming such elements in order to achieve a higher withstand voltage; it is required to increase such elements in size for the reason that the on-resistance must be lowered even with the elements each having a large withstand voltage; and the circuit area is increased by the widening of the space and the increase in the size. In addition, it has been found that the process of forming elements each having a high withstand voltage increases the number of masks to be used in fabrication.

These problems are not limited to display driver ICs. They are problems which pop up in general for voltage transmission circuits arranged so that voltages of positive and negative polarities are multiplexed and sequentially transmitted between ICs.

It is one objective of the invention to provide: a voltage transmission circuit arranged so that voltages of positive and negative polarities are multiplexed and sequentially transmitted between ICs without using elements each having a high withstand voltage; and a voltage transmitting circuit and a voltage receiving circuit therefor.

While the means for solving these problems will be described below, the other objects and novel features thereof will be apparent from the description hereof and the accompanying diagrams.

A voltage transmission circuit according to one embodiment is as follows.

The voltage transmission circuit has a multiplexer and a demultiplexer, and selectively transmits a positive voltage higher than a ground potential from the multiplexer to a positive output of the demultiplexer, and negative voltages lower than the ground potential from the multiplexer to a negative output of the demultiplexer. The voltage transmission circuit is arranged as follows.

The voltage transmission circuit has a positive power source (e.g. +VDD) higher than the ground potential (0 V), and a negative power source (e.g. −VDD) lower than the ground potential.

In case that the voltage transmission circuit transmits the positive voltage, the multiplexer is allowed to accept the input of the positive voltages, but is blocked from accepting the input of the negative voltages, and is controlled by multiplexer-control signals having potentials within a range of the ground potential to the positive power source to transmit the positive voltages to the demultiplexer. The demultiplexer is controlled by demultiplexer-control signals having potentials within a range of the ground potential to the positive power source and thus, outputs the positive voltages transmitted thereto from the positive output, and outputs the ground potential from the negative output.

In case that the voltage transmission circuit transmits the negative voltage, the multiplexer is allowed to accept the input of the negative voltages, but is blocked from accepting the input of the positive voltages, and is controlled by multiplexer-control signals having potentials within a range of the ground potential to the negative power source, whereby the negative voltages are transmitted to the demultiplexer. The demultiplexer is controlled by demultiplexer-control signals having potentials within a range of the ground potential to the negative power source and thus, outputs the negative voltages transmitted thereto from the negative output, and outputs the ground potential from the positive output.

The effect that the above embodiment brings about will be briefly described below.

The multiplexer and the demultiplexer can be composed of elements each having a withstand voltage (e.g. −VDD+Margin) which achieves resistance against not a voltage (e.g. |+VDD−(−VDD)|=2VDD) having an absolute value as large as |Positive power source −Negative power source|, but a voltage given by a voltage having, of |Positive power source| and |Negative power source|, a larger absolute value plus a margin. In the condition shown by example concerning the embodiment, −VDD>0, and the positive power source and the negative power source are identical to each other in absolute value (|+VDD|=|−VDD|), which does not imply the exclusion of the cases that the positive power source and the negative power source are different from each other in absolute value (+VDD1>0 V>−VDD2).

1. Summary of the Embodiments

First, summary of representative embodiments of the invention disclosed in the application will be described. Reference numerals in drawings in parentheses referred to in description of the summary of the representative embodiments just denote components included in the concept of the components to which the reference numerals are designated.

[1] Control Signal Potentials of MUX/DEMUX According to the Polarity of Voltages to be Transmitted A voltage transmission circuit (100) according to a representative embodiment disclosed in this application includes a multiplexer (1) and a demultiplexer (2). The voltage transmission circuit causes the multiplexer to selectively transmit: positive voltages (SLEVP_M) higher than a ground potential (GND, AGND) to a positive output (SLEVP_S) of the demultiplexer; and negative voltages (SLEVN_M) lower than the ground potential to a negative output (SLEVN_S) of the demultiplexer.

The voltage transmission circuit (100) has a positive power source (+VDD, GVDD) higher than the ground potential, and a negative power source (−VDD, GVDDN) lower than the ground potential.

In transmitting the positive voltages, the multiplexer is allowed to accept the input of the positive voltages, but is blocked from accepting the input of the negative voltages, and is controlled by multiplexer-control signals having potentials within a range of the ground potential to the positive power source to transmit the positive voltages to the demultiplexer. The demultiplexer is controlled by demultiplexer-control signals having potentials within a range of the ground potential to the positive power source and thus, outputs the positive voltages transmitted thereto from the positive output, and outputs the ground potential from the negative output.

In transmitting the negative voltages, the multiplexer is allowed to accept the input of the negative voltages, but is blocked from accepting the input of the positive voltages, and is controlled by multiplexer-control signals having potentials within a range of the ground potential to the negative power source, whereby the negative voltages are transmitted to the demultiplexer. The demultiplexer is controlled by demultiplexer-control signals having potentials within a range of the ground potential to the negative power source and thus, outputs the negative voltages transmitted thereto from the negative output, and outputs the ground potential from the positive output.

According to this embodiment, the multiplexer (1) and the demultiplexer (2) can include elements each having a withstand voltage which achieves resistance against not a voltage having an absolute value as large as |Positive power source −Negative power source|, but a voltage having, of |Positive power source| and |Negative power source|, a larger absolute value. For instance, supposing Positive power source (+VDD)≥Transmitted positive voltage (+Vref)>Ground potential (0 V), and Negative power source (−VDD)≤Transmitted negative voltage (−Vref)<Ground potential (0 V), it is not always required to form the multiplexer (1) and the demultiplexer (2) by elements each having a withstand voltage which achieves resistance against |Positive power source −Negative power source|=2VDD or larger. They may be elements having a withstand voltage (VDD+Margin) given by VDD plus a margin.

[2] Sequence for Averting the Withstand Voltage Violation

In the item [1], the voltage transmission circuit (100) works according to a sequence as described below.

In the case of transmitting negative voltages after transmission of positive voltages, before transmission of the negative voltages, the multiplexer is blocked from accepting the input of the positive voltages, and outputs the ground potential to the demultiplexer, and the multiplexer-control signals are switched to those having potentials within the range of the ground potential to the negative power source. As to the demultiplexer, the demultiplexer-control signals are switched to those having potentials within the range of the ground potential to the negative power source, and the demultiplexer outputs the ground potential from the positive output.

In the case of transmitting positive voltages after transmission of negative voltages, before transmission of the positive voltages, the multiplexer is blocked from accepting the input of the negative voltages, and outputs the ground potential to the demultiplexer, and the multiplexer-control signals are switched to those having potentials within the range of the ground potential to the positive power source. As to the demultiplexer, the demultiplexer-control signals are switched to those having potentials within the range of the ground potential to the positive power source, and the demultiplexer outputs the ground potential from the negative output.

According to this embodiment, the risk of transiently causing the withstand voltage violation in the course of switching can be averted even in the case of mutually switching between the transmission of positive voltages and the transmission of negative voltages.

[3] CMOS Switch with Middle Withstand Voltage, and Well Potential Control Circuit In the item [1], the voltage transmission circuit includes: at least one transmitting circuit (10) having the multiplexer, an input-select-control part (3) supplied with the multiplexer-control signal, and a transmitting terminal (5); and at least one receiving circuit (20) having a receiving terminal (6), the demultiplexer, and an output-select-control part (4) supplied with the demultiplexer-control signal.

The multiplexer includes a first CMOS switch (SWP2_M) to which the positive voltage can be input and which is connected with the transmitting terminal, and a second CMOS switch (SWN2_M) to which the negative voltage can be input and which is connected with the transmitting terminal.

The demultiplexer includes a third CMOS switch (SWP2_S) connected between the receiving terminal and the positive output, and a fourth CMOS switch (SWN2_S) connected between the receiving terminal and the negative output.

The input-select-control part controls gate electrode potentials of MOS transistors (P_SWP2_M, N_SWP2_M, P_SWN2_M, N_SWN2_M) constituting the first and second CMOS switches, and well potentials thereof by the multiplexer-control signals, respectively.

The output-select-control part controls gate electrode potentials of MOS transistors (P_SWP2_S, N_SWP2_S, P_SWN2_S, N_SWN2_S) constituting the third and fourth CMOS switches, and well potentials by the demultiplexer-control signals, respectively.

According to this embodiment, the withstand voltage of each of MOS transistors constituting the first to fourth CMOS switches can be made a withstand voltage which achieves resistance against a voltage having, of |Positive power source| and |Negative power source|, a larger absolute value. In the embodiment as described in the item [1], the withstand voltage of each MOS transistor can be made not a withstand voltage which achieves resistance against a voltage having an absolute value as large as |Positive power source −Negative power source|=2VDD, but a withstand voltage (VDD+Margin) given by VDD plus a margin.

[4] MUX-Input Side Switches and DEMUX-Output Side Switches

In the item [3], the multiplexer further includes: a fifth CMOS switch (SWP1_M) connected between the positive voltage and the first CMOS switch; a first shunt switch (SWPS_M) by which the connection node of the first CMOS switch and the fifth CMOS switch can be short-circuited to the ground potential; a sixth CMOS switch (SWN1_M) connected between the negative voltage and the second CMOS switch; and a second shunt switch (SWNS_M) by which the connection node of the second CMOS switch and the sixth CMOS switch can be short-circuited to the ground potential.

The demultiplexer further includes: a seventh CMOS switch (SWP1_S) connected between the third CMOS switch and the positive output; a third shunt switch (SWPS_S) by which the connection node of the third CMOS switch and the seventh CMOS switch can be short-circuited to the ground potential; an eighth CMOS switch (SWN1_S) connected between the fourth CMOS switch and the negative output; and a fourth shunt switch (SWNS_S) by which the connection node of the fourth CMOS switch and the eighth CMOS switch can be short-circuited to the ground potential.

This embodiment provides a circuit suitable to execute the sequence for averting the withstand voltage violation as described in the item [2].

The multiplexer turns on the fifth CMOS switch to output from the first CMOS switch when sending out a positive voltage; the multiplexer turns on the sixth CMOS switch to output from the second CMOS switch when sending out a negative voltage. In any of the cases, the positive or the negative voltage, which is not targeted for the sending, is cut off from the first or second CMOS switch by turning off the fifth or sixth CMOS switch, and the connection node concerned is short-circuited (shunted) to the ground potential by the first or second shunt switch. The first and second CMOS switches work between the positive or negative voltages, which are sent (selected), and the ground potential; the fifth and sixth CMOS switches work between the positive or negative voltages, which are not targeted for the sending (unselected), and the ground potential. Therefore, each withstand voltage of the switches may be a withstand voltage (VDD+Margin) given by the positive or negative power source plus a margin.

The demultiplexer turns on the seventh CMOS switch to connect the third CMOS switch to the positive output when receiving positive voltages; the demultiplexer turns on the eighth CMOS switch to connect the fourth CMOS switch to the negative output when receiving negative voltages. In any of the cases, the positive or negative output, which is not targeted for the receiving, is cut off from the third or fourth CMOS switch by turning off the seventh or eighth CMOS switch, and the connection node concerned is short-circuited (shunted) to the ground potential by the third or fourth shunt switch. The third and fourth CMOS switches work between the positive or negative voltage, which is received, and the ground potential; the seventh and eighth CMOS switches work between the positive or negative voltage and the ground potential. Therefore, each withstand voltage of the switches may be a withstand voltage (VDD+Margin) given by the positive or negative power source plus a margin.

[5] One-to-Multiple Voltage Transmission

In the voltage transmission circuit (100) as described in the item [3] or [4], the number of the at least one transmitting circuit (10) is one, and the number of the at least one receiving circuit (20_1, 20_2) is more than one.

This embodiment enables the voltage transmission from one transmitting circuit to more than one receiving circuit.

[6] Voltage Transmission Between Chips

In the items [3], [4] and [5], the at least one transmitting circuit and the at least one receiving circuit are formed as integrated circuits on different semiconductor substrates respectively.

This embodiment offers a circuit for voltage transmission between different semiconductor integrated circuit chips.

[7] Display Driver

In the items [3] and [4], the at least one transmitting circuit (10) further includes gradation-reference-voltage-generating parts (11_P, 11_N), and gradation-reference-voltage-selecting parts (12_P, 12_N). The gradation-reference-voltage-generating parts generate positive side gradation reference voltages higher than the ground potential, and negative side gradation reference voltages lower than the ground potential. The gradation-reference-voltage-selecting parts each select one of the positive side gradation reference voltages, and supply the multiplexer (1) with the selected gradation reference voltages as the positive voltages (SLEVP_M), and each select one of the negative side gradation reference voltages, and supply the multiplexer (1) with the selected gradation reference voltage as the negative voltage (SLEVN_M).

The at least one receiving circuit (20) further includes: a gradation-reference-voltage-selecting-and-supplying part (21); gradation-reference-voltage-holding-and-generating parts (22_P, 22_N); and a source line activation part. The gradation-reference-voltage-selecting-and-supplying part supplies positive voltages (SLEVP_S) or negative voltages (SLEVN_S) output by the demultiplexer to the gradation-reference-voltage-holding-and-generating parts. The gradation-reference-voltage-holding-and-generating parts each have a gradation-reference-voltage-holding part including voltage-holding circuits, and hold, as gradation reference voltages, positive or negative voltages supplied from the gradation-reference-voltage-selecting-and-supplying part in the voltage-holding circuits, and produce gradation voltages based on the gradation reference voltages. The source line activation part activates source lines of a display panel connected thereoutside based on the gradation voltages.

According to this embodiment, the withstand voltages of elements included in the transmission circuit when transmitting gradation reference voltages between display drivers composed of chips can be kept down as in the embodiment of the item [1]. Now, it is noted that the voltage-holding circuits which are arranged by use of sample-and-hold circuits capable of holding analog voltages, or registers capable of holding the voltages of digital values may be mounted. In the case of holding voltages as digital values, the at least receiving circuit includes an analog-to-digital converter for converting positive voltages (SLEVP_S) or negative voltages (SLEVN_S) transmitted in analog forms into digital values. Alternatively, the at least receiving circuit may include a calibration circuit which adjusts gradation reference voltages generated in the receiving circuit (20) based on positive voltages (SLEVP_S) or negative voltages (SLEVN_S) transmitted thereto, and trimming values which are results of the adjustment may be stored in a register.

[8] Sequence for Transmission of Gradation Reference Voltages

The voltage transmission circuit (100) as described in the item [7] works as follow.

In the case of transmitting the positive side gradation reference voltages, the at least one transmitting circuit uses the gradation-reference-voltage-selecting part to sequentially select, from the positive side gradation reference voltages, one at a time, and the selected gradation reference voltage is sent from the multiplexer as the positive voltage. In the case of transmitting the negative side gradation reference voltages, the at least one transmitting circuit uses the gradation-reference-voltage-selecting part to sequentially select, from the negative side gradation reference voltages, one at a time, and the selected gradation reference voltage is sent from the multiplexer as the negative voltage.

The receiving circuit uses the gradation-reference-voltage-selecting-and-supplying part to sequentially supply the voltage-holding circuits with positive or negative voltages output by the demultiplexer, thereby having the voltage-holding circuits hold the positive or negative voltages.

This embodiment provides a transmission sequence for transmitting gradation reference voltages between display drivers composed of chips.

[9] Sequence for Averting the Withstand Voltage Violation

The voltage transmission circuit (100) as described in the item [8] works as follow.

In the case of transmitting negative side gradation reference voltages after transmission of positive side gradation reference voltages, before transmission of the negative side gradation reference voltages, the multiplexer is blocked from accepting the input of the positive voltages, and outputs the ground potential to the demultiplexer, and the multiplexer-control signals are switched to those having potentials within the range of the ground potential to the negative power source. As to the demultiplexer, the demultiplexer-control signals are switched to those having potentials within the range of the ground potential to the negative power source, and the demultiplexer outputs the ground potential from the positive output.

In the case of transmitting positive side gradation reference voltages after transmission of negative side gradation reference voltages, before transmission of the positive side gradation reference voltages, the multiplexer is blocked from accepting the input of the negative voltages, and outputs the ground potential to the demultiplexer, and the multiplexer-control signals are switched to those having potentials within the range of the ground potential to the positive power source. As to the demultiplexer, the demultiplexer-control signals are switched to those having potentials within the range of the ground potential to the positive power source, and the demultiplexer outputs the ground potential from the negative output.

According to this embodiment, the risk of transiently causing the withstand voltage violation in the course of switching can be averted as in the embodiment of the item [2], even in the case of switching transmission voltages between the transmission of positive side gradation reference voltages, and the transmission of negative side gradation reference voltages.

[10] Voltage Transmitting Circuit

A voltage transmitting circuit (10) according to a representative embodiment disclosed in this application has a multiplexer (1), wherein the multiplexer selects transmission voltages (Gamma_out) from positive voltages (SLEVP_M) higher than a ground potential (GND, AGND), and negative voltages (SLEVN_M) lower than the ground potential, and sends the selected transmission voltages to a voltage receiving circuit (20) connected thereoutside.

The voltage transmitting circuit (10) has a positive power source (+VDD, GVDD) higher than the ground potential, and a negative power source (−VDD, GVDDN) lower than the ground potential.

In sending out the positive voltage as the transmission voltage, the multiplexer is allowed to accept the input of the positive voltages, but is blocked from accepting the input of the negative voltages, and is controlled by multiplexer-control signals having potentials within a range of the ground potential to the positive power source to send the positive voltages as the transmission voltages.

In sending out the negative voltage as the transmission voltage, the multiplexer is allowed to accept the input of the negative voltages, but is blocked from accepting the input of the positive voltages, and is controlled by multiplexer-control signals having potentials within a range of the ground potential to the negative power source to send the negative voltages as the transmission voltages.

According to this embodiment, it is possible to bring about the same effect as achieved by the embodiment of the item [1] as to the voltage transmitting circuit included in the voltage transmission circuit as described in the item [1]. That is, the multiplexer can be composed of elements each having a withstand voltage which achieves resistance against not a voltage having an absolute value as large as |Positive power source −Negative power source|, but a voltage having, of |Positive power source| and |Negative power source|, a larger absolute value.

[11] Display Driver (Master)

The voltage transmitting circuit (10) as described in the item [10] further includes:

gradation-reference-voltage-generating parts (11_P, 11_N); and gradation-reference-voltage-selecting parts (12_P, 12_N).

The gradation-reference-voltage-generating parts generate positive side gradation reference voltages higher than the ground potential, and negative side gradation reference voltages lower than the ground potential. The gradation-reference-voltage-selecting parts each select one of the positive side gradation reference voltages, and supply the multiplexer (1) with the selected gradation reference voltages as the positive voltages (SLEVP_M), and each select one of the negative side gradation reference voltages, and supply the multiplexer (1) with the selected gradation reference voltage as the negative voltage (SLEVN_M).

According to this embodiment, the withstand voltages of elements included in the transmission circuit in a master-side display driver which serves as a voltage transmitting circuit when transmitting gradation reference voltages between display drivers composed of chips can be kept down as in the embodiment of the item [1].

[12] Sequence for Transmission of Gradation Reference Voltages (Master Side)

The voltage transmitting circuit (10) as described in the item [11] works as follow.

In the case of transmitting the positive side gradation reference voltages, the gradation-reference-voltage-selecting part sequentially selects, from the positive side gradation reference voltages, one at a time, and the selected gradation reference voltage is sent from the multiplexer as the positive voltage.

In the case of transmitting the negative side gradation reference voltages, the gradation-reference-voltage-selecting part sequentially selects, from the negative side gradation reference voltages, one at a time, and the selected gradation reference voltage is sent from the multiplexer as the negative voltage.

This embodiment provides a transmission sequence for a master side display driver for transmitting gradation reference voltages between display drivers composed of chips.

[13] Sequence for Averting the Withstand Voltage Violation (Master Side)

The voltage transmitting circuit (10) as described in the item [12] works as follow.

In the case of transmitting negative side gradation reference voltages after transmission of positive side gradation reference voltages, before transmission of the negative side gradation reference voltages, the multiplexer is blocked from accepting the input of the positive voltages, and outputs the ground potential to the demultiplexer, and the multiplexer-control signals are switched to those having potentials within the range of the ground potential to the negative power source.

In the case of transmitting positive side gradation reference voltages after transmission of negative side gradation reference voltages, before transmission of the positive side gradation reference voltages, the multiplexer is blocked from accepting the input of the negative voltages, and outputs the ground potential to the demultiplexer, and the multiplexer-control signals are switched to those having potentials within the range of the ground potential to the positive power source.

According to this embodiment, the risk of transiently causing the withstand voltage violation in the course of switching can be averted as in the embodiment of the item [9], in the case of switching transmission voltages between the transmission of positive side gradation reference voltages, and the transmission of negative side gradation reference voltages in a master side display driver operable to transmit gradation reference voltages.

[14] Voltage Receiving Circuit

A voltage receiving circuit (20) according to a representative embodiment disclosed in this application is one which receives transmission voltages (Gamma_out) transmitted from a voltage transmitting circuit (10) connected thereoutside, and includes a demultiplexer (2) having a positive output (SLEVP_S) and a negative output (SLEVN_S).

The voltage receiving circuit has a positive power source (+VDD, GVDD) higher than a ground potential (GND, AGND), and a negative power source (−VDD, GVDDN) lower than the ground potential.

On condition that the voltage receiving circuit receives, as transmission voltages, positive voltages higher than the ground potential, the demultiplexer is controlled by demultiplexer-control signals having potentials within a range of the ground potential to the positive power source, thereby outputting the positive voltages transmitted thereto from the positive output, and the ground potential from the negative output. On condition that the voltage receiving circuit receives, as transmission voltages, negative voltages lower than the ground potential, the demultiplexer is controlled by demultiplexer-control signals having potentials within a range of the ground potential to the negative power source, thereby outputting the negative voltages transmitted thereto from the negative output, and the ground potential from the positive output.

According to this embodiment, it is possible to bring about the same effect as achieved by the embodiment of the item [1] as to the voltage receiving circuit included in the voltage transmission circuit as described in the item [1]. That is, the demultiplexer can be composed of elements each having a withstand voltage which achieves resistance against not a voltage having an absolute value as large as |Positive power source −Negative power source|, but a voltage having, of |Positive power source| and |Negative power source|, a larger absolute value.

[15] Display Driver (Slave)

The voltage receiving circuit as described in the item [14] further includes: a gradation-reference-voltage-selecting-and-supplying part (21); gradation-reference-voltage-holding-and-generating parts (22_P, 22_N); and a source line activation part.

The gradation-reference-voltage-selecting-and-supplying part supplies positive voltages (SLEVP_S) or negative voltages (SLEVN_S) output by the demultiplexer to the gradation-reference-voltage-holding-and-generating parts. The gradation-reference-voltage-holding-and-generating parts each have a gradation-reference-voltage-holding part including voltage-holding circuits, and hold, as gradation reference voltages, positive or negative voltages supplied from the gradation-reference-voltage-selecting-and-supplying part in the voltage-holding circuits, and produce gradation voltages based on the gradation reference voltages. The source line activation part activates source lines of a display panel connected thereoutside based on the gradation voltages.

According to this embodiment, the withstand voltages of elements included in the transmission circuit in a slave-side display driver which serves as a voltage transmitting circuit when transmitting gradation reference voltages between display drivers composed of chips can be kept down as in the embodiment of the item [1].

[16] Sequence for Transmission of Gradation Reference Voltages (Slave Side)

The voltage receiving circuit (20) as described in the item [15] works as follow.

The voltage receiving circuit uses the gradation-reference-voltage-selecting-and-supplying part to sequentially supply the voltage-holding circuits with positive voltages (SLEVP_S) or negative voltages (SLEVN_S) output by the demultiplexer, thereby having the voltage-holding circuits hold the positive or negative voltages.

This embodiment provides a transmission sequence for a slave side display driver or transmitting gradation reference voltages between display drivers composed of chips.

[17] Sequence for Averting the Withstand Voltage Violation (Slave Side)

The voltage receiving circuit (20) as described in the item [16] works as follow.

In the case of transmitting negative side gradation reference voltages after transmission of positive side gradation reference voltages, before transmission of the negative side gradation reference voltages, the demultiplexer-control signals are switched to those having potentials within the range of the ground potential to the negative power source, and the demultiplexer outputs the ground potential from the positive output.

In the case of transmitting positive side gradation reference voltages after transmission of negative side gradation reference voltages, before transmission of the positive side gradation reference voltages, the demultiplexer-control signals are switched to those having potentials within a range of the ground potential to the positive power source, and the demultiplexer outputs the ground potential from the negative output.

According to this embodiment, the risk of transiently causing the withstand voltage violation in the course of switching can be averted as in the embodiment of the item [9], in the case of switching transmission voltages between the transmission of positive side gradation reference voltages, and the transmission of negative side gradation reference voltages in a slave side display driver operable to transmit gradation reference voltages.

2. Further Detailed Description of the Embodiments

The embodiments will be described further in detail.

First Embodiment

FIG. 1 is a block diagram showing an example of the basic configuration of a voltage transmission circuit 100 according to the invention.

The voltage transmission circuit 100 includes a voltage transmitting circuit 10 and a voltage receiving circuit 20. The voltage transmitting circuit 10 includes: a multiplexer 1; an input-select-control part 3 operable to supply control signals to the multiplexer 1; and a transmitting terminal 5 for sending transmission voltages targeted for transmission. The voltage receiving circuit 20 includes: a demultiplexer 2; an output-select-control part 4 operable to supply control signals to the demultiplexer 2; and a receiving terminal 6 for receiving transmission voltages targeted for transmission. The actions of switches SWPM_M and SWNM_M connected with an input of the multiplexer 1, and switches SWPC_M and SWNC_M connected with a power source of the input-select-control part 3 in the voltage transmitting circuit 10, and the actions of switches SWPM_S and SWNM_S connected with an output of the demultiplexer 2, and switches SWPC_S and SWNC_S connected with a power source of the output-select-control part 4 in the voltage receiving circuit 20 are to be described later. In one embodiment, the voltage transmitting circuit 10 and the voltage receiving circuit 20 are each formed on a single semiconductor substrate of silicon or the like by e.g. known CMOS (Complementary Metal-Oxide-Semiconductor field effect transistor) LSI (Large Scale Integrated circuit) manufacturing techniques.

In the voltage transmitting circuit 10, the multiplexer 1 selects one of a positive side voltage VrefP and a negative side voltage VrefN, and sends out the selected voltage as a transmission voltage through the transmitting terminal 5. In the voltage receiving circuit 20, the demultiplexer 2 discriminates a transmission voltage received through the receiving terminal 6 to output to either the positive side output or the negative side output. A positive side voltage from the voltage transmitting circuit 10 is transmitted to the positive side output of the voltage receiving circuit 20, and a negative side voltage from the voltage transmitting circuit 10 is transmitted to the negative side output of the voltage receiving circuit 20. In the case of transmitting voltages of both the positive and negative sides so that more than one voltage is transmitted on each of the positive and negative sides, the transmissions are sequentially performed while synchronizing the multiplexer 1 and the demultiplexer 2 with each other and switching them. The voltages to be transmitted on the positive and negative sides are e.g. reference voltages for causing the display driver to generate gradation voltages, otherwise the voltages may be reference voltages for measurement or control. The voltage transmission circuit 100 according to the invention is preferable for a device operable to transmit identical reference voltages toward more than one measurement point, and a device operable to transmit identical control voltages for causing controllers to perform the same action.

The voltage transmitting circuit 10 and the voltage receiving circuit 20 each have a positive power source (+VDD) higher than the ground potential GND (0 V), and a negative power source (−VDD). Positive voltages VrefP and negative voltages VrefN to be transmitted satisfy the relation between the source voltages given by: +VDD≥VrefP>0 V>VrefN≥−VDD. The voltage transmitting circuit 10 and the voltage receiving circuit 20 may be different from each other in source voltage value. In addition, the source voltages may be different in the absolute value between the positive side and the negative side. The source voltages having identical absolute values (±VDD) are shown by example here, for easier understanding. Further, it is easy to modify, without departing from the subject matter hereof, the voltage transmission circuit 100 to comply with the specifications which enable the action in the conditions of VrefP≥+VDD and VrefN≤−VDD as well.

The action of transmitting voltages will be described.

In transmitting positive voltages VerfP, in the voltage transmitting circuit 10, the positive voltages VerfP are input to one input of the multiplexer 1, and the other input of the multiplexer 1 is blocked from accepting the input of negative voltages VrefN, and shunted to the ground potential (GND, 0 V). The multiplexer 1 selectively outputs the positive voltages VerfP to the transmitting terminal 5. The positive voltages VerfP are output as the transmission voltages. These actions are realized by connecting the switch SWPM_M to the side of the positive voltages VerfP, and the switch SWNM_M to the side of the ground potential (GND, 0 V) in the embodiment shown in FIG. 1. The input-select-control part 3 is supplied with the positive power source (+VDD) and a ground potential GND (0 V) as power sources. The potential of a signal line for controlling the multiplexer 1 is limited in the range of the power sources, i.e. the range of the positive power source (+VDD) to the ground potential GND (0 V). Consequently, the voltages of signals to be applied to the multiplexer 1 are limited in the range of the positive power source (+VDD) to the ground potential GND (0 V).

On the other hand, in the voltage receiving circuit 20, the positive voltages VerfP are input to the demultiplexer 2 through the receiving terminal 6 as the transmission voltages. The electrical continuity on the positive side output of the demultiplexer 2 is established by the switch SWPM_S; the other negative side output is cut off from the demultiplexer 2 by the switch SWNM_S and shunted to the ground potential (GND, 0 V). The output-select-control part 4 is supplied with the positive power source (+VDD) and the ground potential GND (0 V) as power sources. The potential of a signal line for controlling the demultiplexer 2 is limited in the range of the power sources, i.e. the range of the positive power source (+VDD) to the ground potential GND (0 V). Consequently, the voltages of signals to be applied to the demultiplexer 2 are limited in the range of the positive power source (+VDD) to the ground potential GND (0 V).

In transmitting negative voltages VerfN, in the voltage transmitting circuit 10, the one input of the multiplexer 1 is blocked from the positive voltages VrefP, and shunted to the ground potential (GND, 0 V), and the negative voltages VerfN are input to the other input. The multiplexer 1 selectively outputs the negative voltages VerfN to the transmitting terminal 5. The negative voltages VerfN are output as the transmission voltages. These actions are realized by connecting the switch SWPM_M to the side of the ground potential (GND, 0 V), and the switch SWNM_M to the side of the negative voltages VerfN in the embodiment shown in FIG. 1. The input-select-control part 3 is supplied with the negative power source (−VDD) and the ground potential GND (0 V) as power sources. The potential of each signal line for controlling the multiplexer 1 is limited in the range of the power sources, i.e. the range of the negative power source (−VDD) to the ground potential GND (0 V). Consequently, the voltages of signals to be applied to the multiplexer 1 are limited in the range of the negative power source (−VDD) to the ground potential GND (0 V).

On the other hand, in the voltage receiving circuit 20, the negative voltages VerfN are input to the demultiplexer 2 through the receiving terminal 6 as the transmission voltages. The positive side output of the demultiplexer 2 is cut off from the demultiplexer 2 by the switch SWPM_S, and shunted to the ground potential (GND, 0 V); on the other negative side output, the electrical continuity is established by the switch SWNM_S. The output-select-control part 4 is supplied with the negative power source (−VDD) and the ground potential GND (0 V) as power sources. The potential of the signal line for controlling the demultiplexer 2 is limited in the range of the power sources, i.e. the range of the negative power source (−VDD) to the ground potential GND (0 V). Consequently, the voltage of a signal to be applied to the demultiplexer 2 is limited in the range of the negative power source (−VDD) to the ground potential GND (0 V).

As described above, the voltages applied to the multiplexer 1 and the demultiplexer 2 are each limited in the range of the positive power source (+VDD) to the ground potential GND (0 V) in transmitting positive voltages VerfP, whereas they are each limited in the range of the negative power source (−VDD) to the ground potential GND (0 V) in transmitting a negative voltage VerfN. In the case of transmitting any of positive and negative voltages, either of the multiplexer and the demultiplexer can be composed of elements each having a withstand voltage which achieves resistance against not a voltage having an absolute value as large as |Positive power source −Negative power source|, but a voltage having, of |Positive power source| and |Negative power source|, a larger absolute value, provided that |+VDD|=|−VDD|=VDD in the above embodiment.

The switching of the transmission voltage between the positive voltage VerfP and the negative voltage VerfN will be described.

In the case of transmitting negative voltages VerfN after transmission of positive voltages VerfP, before transmission of the negative voltages VerfN, the switch SWPM_M blocks the positive voltages VerfP from going into the input of the multiplexer 1, and shunts the input to the ground potential (GND, 0 V). Thus, both of the inputs of the multiplexer 1 are shunted to the ground potential (GND, 0 V), and the ground potential (0 V) is output from the transmitting terminal 5. After that, the power source supplied to the input-select-control part 3 is switched by the switches SWPC_M and SWNC_M from a combination of the positive power source (+VDD) and the ground potential GND (0 V) to a combination of the negative power source (−VDD) and the ground potential GND (0 V). At the time, the control signals of the multiplexer 1 can be changed from +VDD to −VDD, but the event that both the power sources +VDD and −VDD are applied to the multiplexer at a time even transiently (or the withstand voltage violation) never occurs because of the input shunted to zero (0) volt. In line with the switching of the power source, the power source supplied to the output-select-control circuit 4 is switched by the switches SWPC_S and SWNC_S from the combination of the positive power source (+VDD) and the ground potential GND (0 V) to the combination of the negative power source (−VDD) and the ground potential GND (0 V) in the voltage receiving circuit 20. In addition, the positive side output of the demultiplexer 2 is shunted to the ground potential (0 V). At the time, the control signals of the demultiplexer 2 can be changed from +VDD to −VDD, but the event that both the power sources +VDD and −VDD are applied to the demultiplexer 2 at a time even transiently (or the withstand voltage violation) never occurs because of the input shunted to zero (0) volt. After that, in the voltage transmitting circuit 10, the negative voltages VrefN are supplied to the input of the multiplexer 1, and selectively output from the transmitting terminal 5. In the voltage receiving circuit 20, the received negative voltages VrefN are passed to the demultiplexer 2, and then output to the negative side output.

In contrast, in the case of transmitting positive voltages VerfP after transmission of negative voltages VerfN, before transmission of the positive voltages VerfP, the switch SWNM_M blocks the negative voltages VerfN from going into the input of the multiplexer 1, and shunts the input to the ground potential (GND, 0 V). Thus, both of the inputs of the multiplexer 1 are shunted to the ground potential (GND, 0 V), and the ground potential (0 V) is output from the transmitting terminal 5. After that, the power source supplied to the input-select-control part 3 is switched by the switches SWPC_M and SWNC_M from a combination of the negative power source (−VDD) and the ground potential GND (0 V) to a combination of the positive power source (+VDD) and the ground potential GND (0 V). At the time, the control signals of the multiplexer 1 can be changed from −VDD to +VDD, but the event that both the power sources +VDD and −VDD are applied to the multiplexer at a time even transiently (or the withstand voltage violation) never occurs because of the input shunted to zero (0) volt. In line with the switching of the power source, the power source supplied to the output-select-control circuit 4 is switched by the switches SWPC_S and SWNC_S from the combination of the negative power source (−VDD) and the ground potential GND (0 V) to the combination of the positive power source (+VDD) and the ground potential GND (0 V) in the voltage receiving circuit 20. In addition, the negative side output of the demultiplexer 2 is shunted to the ground potential (0 V). At the time, the control signals of the demultiplexer 2 can be changed from +VDD to −VDD, but the event that both the power sources +VDD and −VDD are applied to the demultiplexer 2 at a time even transiently (or the withstand voltage violation) never occurs because of the input shunted to zero (0) volt. After that, in the voltage transmitting circuit 10, the positive voltages VrefP are supplied to the input of the multiplexer 1, and selectively output from the transmitting terminal 5. In the voltage receiving circuit 20, the received positive voltages VrefP are passed to the demultiplexer 2, and then output to the positive side output.

According to this embodiment, the risk of transiently causing the withstand voltage violation in the course of switching can be averted even in the case of mutually switching between the transmission of positive voltages VrefP and the transmission of negative voltages VrefN.

While the voltage transmitting circuit 10 having the switches SWPM_M, SWNM_M, SWPC_M and SWNC_M, and the voltage receiving circuit 20 having the switches SWPM_S, SWNM_S, SWPC_S and SWNC_S are shown in FIG. 1, combinations of the switches are just examples of forms for materializing the sequence for the voltage application as described above, and such sequence may be implemented by other forms.

It is preferable that the voltage transmitting circuit 10 and the voltage receiving circuit 20 work in synchronization with each other in terms of polarity of the voltage to be transmitted, positive voltage VrefP or negative voltage VrefN. Arranging the voltage transmitting circuit 10 and the voltage receiving circuit 20 to receive control signals for the synchronization, the control of the timing for the switching can be performed correctly. Further, instead of arranging the voltage transmitting circuit 10 and the voltage receiving circuit 20 to receive control signals for the synchronization, they may be arranged so that the voltage receiving circuit 20 is provided with a circuit for determining the polarity of transmission voltages; and the output-select-control part 4 and the like are controlled based on the polarity of the transmission voltages.

The invention may be applied to only one of the voltage transmitting circuit 10 and the voltage receiving circuit 20. The reason for this is as follows. That is, in the case of forming a voltage transmission circuit by use of a semiconductor chip including the voltage transmitting circuit 10, and a semiconductor chip including the voltage receiving circuit 20, it is not necessarily required to adopt the invention as long as a chip arranged so that an element having a high withstand voltage can be incorporated therein is used. Even in the case of using, in a voltage transmission circuit, chips each arranged so that a high-withstand voltage element can be incorporated therein, the multiplexer 1 and the demultiplexer 2 can be formed by elements having lower withstand voltages without using high-withstand voltage elements as long as the invention is applied to the voltage transmission circuit. Therefore, it is still possible to achieve the effect of reducing the chip area.

While in the embodiment shown in FIG. 1, one voltage transmitting circuit 10 is connected with one voltage receiving circuit 20, it is possible to provide more than one voltage receiving circuit.

Figure 2:
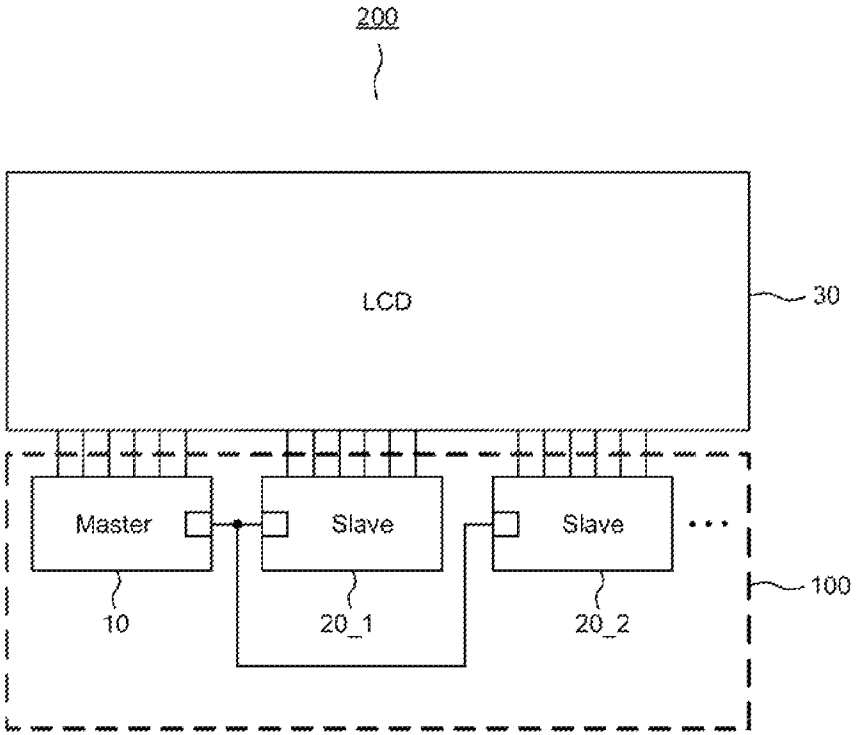
FIG. 2 is a block diagram showing an example of the configuration of a liquid crystal display to which the voltage transmission circuit according to the invention is applied.

FIG. 2 is a block diagram showing an example of the configuration of a liquid crystal display 200 to which the voltage transmission circuit 100 according to the invention is applied. The liquid crystal display 200 includes a liquid crystal display (LCD) panel 30, and chips of display drivers 10, 20_1, 20_2, etc. The display drivers 10, 20_1, 20_2, etc. are each composed of a single semiconductor chip (IC) and mounted on the glass substrate of the liquid crystal display (LCD) panel 30, and serve to activate source lines connected thereto. To each source line, voltages corresponding to image data to be displayed by pixels arranged on the line are applied. As to the voltages corresponding to such image data, voltages corresponding to image data to be displayed are selected or produced from gradation voltages produced by the respective display drivers 10, 20_1, 20_2, etc., and in one embodiment there is no difference for each gradation between gradation voltages produced by the display drivers 10, 20_1, 20_2, etc. As shown in FIG. 2, one display driver 10 is used as a master, and made to function as a voltage transmitting circuit 10, whereas the other display drivers 20_1, 20_2, etc. are used as slaves and made to serve as voltage receiving circuits 20. The master display driver 10 serving as the voltage transmitting circuit 10 transmits, to the slave display drivers 20_1, 20_2, etc., gradation reference voltages for the display drivers 10, 20_1, 20_2, etc. to produce gradation voltages, whereby gradation voltages identical to each other can be produced. As described above, two sets of gradation reference voltages are utilized in a liquid crystal display for the purpose of preventing the burn-in of a liquid crystal panel in general, which are composed of a set of positive side gradation reference voltages and a set of negative side gradation reference voltages. The gradation reference voltages range e.g. 0 to +6 V on the positive side, and 0 to −6 V on the negative side. The number of gradations of gradation voltages depends on the number of bits of image data. It suffices to just transmit gradation reference voltages for producing the gradation voltages while culling them to the extent that the gamma characteristics of the display panel can be corrected with adequate accuracy.

Figure 3:
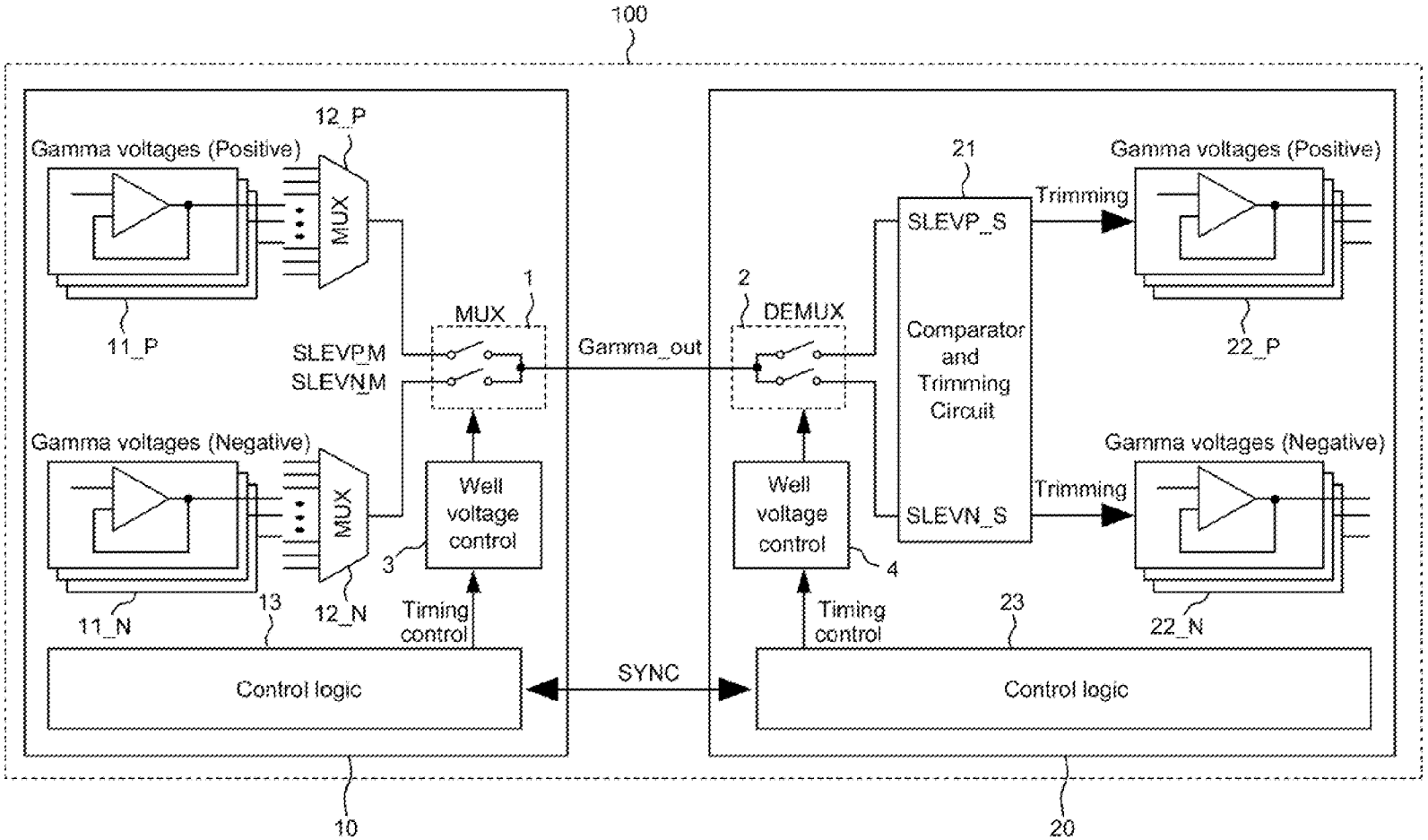
FIG. 3 is a block diagram showing an example of the configuration of the liquid crystal display of FIG. 2 further in detail.

FIG. 3 is a block diagram showing an example of the configuration of the liquid crystal display 200 of FIG. 2 further in detail.

Referring to FIG. 3, only one master display driver 10 and one slave display driver 20 and especially, only parts of the circuits involved in the transmission of gradation reference voltages are shown.

The master display driver 10 includes: a positive side gradation-reference-voltage-generating part (Gamma voltages (Positive)) 11_P; a positive side gradation-reference-voltage-selecting part 12_P; a negative side gradation-reference-voltage-generating part (Gamma voltages (Negative)) 11_N; a negative side gradation-reference-voltage-selecting part 12_N; a multiplexer 1; an input-select-control part (Well voltage control) 3; and a control part (Control logic) 13. The gradation-reference-voltage-generating part 11_P produces gradation reference voltages of the positive side, e.g. reference voltages of a dozen or so gradations in a range of 0 to +6 V. The gradation-reference-voltage-selecting part 12_P selects one of the positive side gradation reference voltages, and inputs the selected one gradation reference voltage to the positive side SLEVP_M of the multiplexer 1. The gradation-reference-voltage-generating part 11_N produces gradation reference voltages of the negative side, e.g. reference voltages of a dozen or so gradations in a range of −6 to 0 V. The gradation-reference-voltage-selecting part 12_N selects one of the negative side gradation reference voltages, and inputs the selected one gradation reference voltage to the negative side SLEVN_M of the multiplexer 1. The multiplexer 1 and the input-select-control part 3 work in the same ways as those in FIG. 1. The input-select-control part 3 is set so that the potentials of the control signals of the multiplexer 1 are in a range of 0 V to +VDD, by setting the voltage of the power source supplied thereto to fall in the range of 0 V to +VDD, and it is set so that the potentials of the control signals of the multiplexer 1 are in a range of 0 V to −VDD, by setting the voltage of the power source supplied thereto to fall in the range of 0 V to −VDD. The control signals of the multiplexer 1 include a control signal for supplying a well potential of a pass gate (MOS transistor) included in the multiplexer. The control part 13 performs the timing control on the input-select-control part 3.

The slave display driver 20 includes: a demultiplexer 2; an output-select-control part 4; a gradation-reference-voltage-selecting-and-supplying part (Comparator and Trimming Circuit) 21; positive and negative side gradation-reference-voltage-holding-and-generating parts (Gamma voltages (Positive/Negative)) 22_P and 22_N; and a control part (Control logic) 23. The demultiplexer 2 and the output-select-control part 4 work in the same ways as those in the first embodiment. The control part 23 performs the timing control on the output-select-control part 4. To the gradation-reference-voltage-selecting-and-supplying part (Comparator and Trimming Circuit) 21, positive outputs SLEVP_S and negative outputs SLEVN_S of the demultiplexer 2 are input individually, and then supplied to the positive and negative side gradation-reference-voltage-holding-and-generating parts (Gamma voltages (Positive/Negative)) 22_P and 22_N. The gradation-reference-voltage-selecting-and-supplying part (Comparator and Trimming Circuit) 21 holds positive side voltages and negative side voltages sequentially transmitted to the positive output SLEVP_S and the negative output SLEVN_S of the demultiplexer 2, and supplies them to the positive and negative side gradation-reference-voltage-holding-and-generating parts (Gamma voltages (Positive/Negative)) 22_P and 22_N. The positive and negative side gradation-reference-voltage-holding-and-generating parts (Gamma voltages (Positive/Negative)) 22_P and 22_N have analog sample-and-hold circuits provided therein, the number of which is equal to the number of required gradation reference voltages. The transmitted positive side voltages and negative side voltages are sampled and held (or retained) by the analog sample-and-hold circuits on each receipt thereof; the positive and negative side voltages are held in analog. The sample-and-hold circuits may be provided in the positive and negative side gradation-reference-voltage-holding-and-generating parts (Gamma voltages (Positive/Negative)) 22_P and 22_N. Further, they can hold positive side voltages and negative side voltages transmitted thereto in the forms of digital values. For instance, the transmitted positive side voltages and negative side voltages may be converted to digital values by an analog-to-digital converter, which can be held in registers. In addition, e.g. the positive and negative side gradation-reference-voltage-holding-and-generating parts (Gamma voltages (Positive/Negative)) 22_P and 22_N may be arranged to generate their own gradation reference voltages respectively, to compare the gradation reference voltages thus generated with gradation reference voltages transmitted thereto, and to hold adjustment values (calibration values or trimming values), which are differences therebetween, in analog or digital. In the case of holding them in digital, the change of the values thus held with time is avoided and as such, all that is required is to execute the transmission of gradation reference voltages once at power-up. Even if any difference occurs between the master and slave in gradation reference voltage owing to the change in environment such as the change in temperature, such difference can be corrected by periodically performing the transmission of the voltages. The demultiplexer 1 and the output-select-control part 4 work in the same ways as those in the first embodiment. The output-select-control part 4 is set so that the potentials of the control signals of the demultiplexer 2 are in a range of 0 V to +VDD, by setting the voltage of the power source supplied thereto to fall in the range of 0 V to +VDD, and it is set so that the potentials of the control signals of the demultiplexer 2 are in a range of 0 V to −VDD, by setting the voltage of the power source supplied thereto to fall in the range of 0 V to −VDD. The control signals of the demultiplexer 2 include a control signal for supplying a well potential of a pass gate (MOS transistor) included in the demultiplexer. The control part 23 performs the timing control on the output-select-control part 4.

The control part 13 on the side of the voltage transmitting circuit 10, and the control part 23 on the side of the voltage receiving circuit 20 receive synchronizing signals SYNC (e.g. a horizontal synchronizing signal HSYNC and a vertical synchronizing signal VSYNC) from each other, perform synchronization timing control according to whether to transmit positive side gradation reference voltages or negative side gradation reference voltages, and execute the above sequence for averting the withstand voltage violation, etc.

Figure 4:
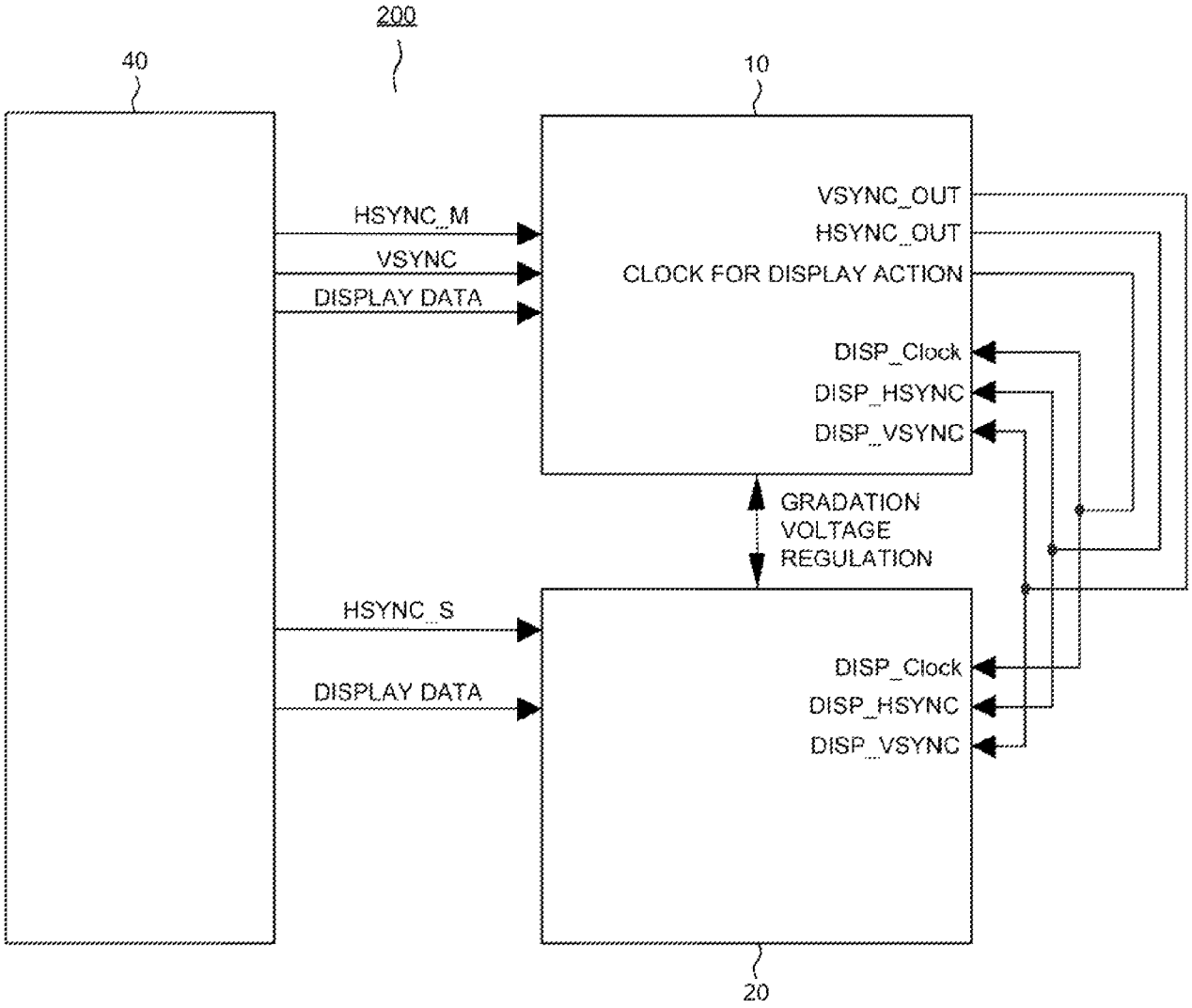
FIG. 4 is a block diagram showing the configuration for transmission of gradation reference voltages in the liquid crystal display of FIG. 2.

FIG. 4 is a block diagram showing the configuration for transmission of gradation reference voltages in the liquid crystal display 200 of FIG. 2.

The master display driver 10 and the slave display driver 20 are connected with a host processor 40 individually, and supplied with horizontal synchronizing signals HSYNC_M and HSYNC_S, and respective display data. The master display driver 10 is further supplied with a vertical synchronizing signal VSYNC. The master display driver 10 produces clocks for display action, a vertical synchronizing signal VSYNC_OUT and a horizontal synchronizing signal HSYNC_OUT from the supplied vertical synchronizing signal VSYNC and horizontal synchronizing signal HSYNC_M, and outputs them. The output clocks for display action, vertical synchronizing signal VSYNC_OUT and horizontal synchronizing signal HSYNC_OUT are input to a display clock DISP_Clock, a display vertical synchronizing signal DISP_VSYNC, and a display horizontal synchronizing signal DISP_HSYNC of each of the master display driver 10 and slave display driver 20, respectively. Thus, it becomes possible to synchronize the display drivers with each other in timing control for display. The same synchronizing signals can be also utilized for synchronization for gradation reference voltage transmission.

Figure 5:
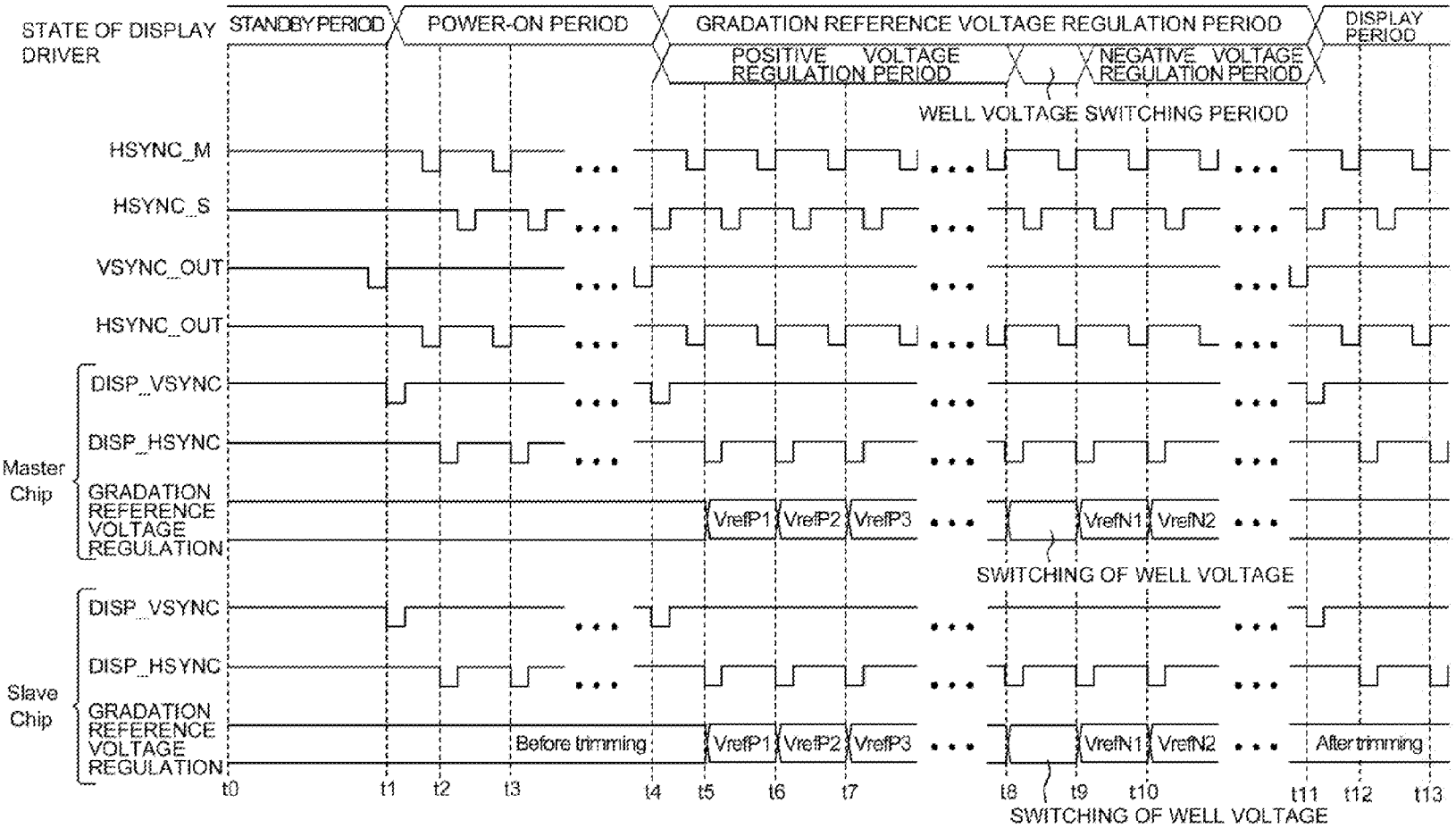
FIG. 5 is a timing diagram showing an example of a transmission sequence of gradation reference voltages in the liquid crystal display of FIG. 4.

FIG. 5 is a timing diagram showing an example of a transmission sequence of gradation reference voltages in the liquid crystal display 200 of FIG. 4. The horizontal axis shows time; and the vertical axis shows, in turn from the top in a vertical axis direction thereof, the state of the display driver, HSYNC_M, HSYNC_S, VSYNC_OUT, HSYNC_OUT, and of each of the master display driver 10 and the slave display driver 20, a display vertical synchronizing signal DISP_VSYNC and a display horizontal synchronizing signal DISP_HSYNC, and the action for gradation reference voltage regulation. HSYNC_M and HSYNC_S represent horizontal synchronizing signals which are input from the host processor 40 to the master display driver 10 and the slave display driver 20 respectively. VSYNC_OUT and HSYNC_OUT represent a vertical synchronizing signal and a horizontal synchronizing signal, which are output from the master display driver 10, respectively. DISP_VSYNC and DISP_HSYNC represent a display vertical synchronizing signal and a display horizontal synchronizing signal which are to be supplied to the master display driver 10 and the slave display driver 20; DISP_VSYNC to the master display driver 10 and DISP_VSYNC to the slave display driver 20 synchronize with each other because they are produced from the same VSYNC_OUT. Likewise, DISP_HSYNC to the master display driver 10 and DISP_HSYNC to the slave display driver 20 synchronize with each other because they are produced from the same HSYNC_OUT.

The period of Time t0 to t1 represents a standby period; the period of Time t1 to t4 represents a power-on period; the period of Time t4 to t11 represents a gradation reference voltage regulation period; and the period from Time t11 onward represents a display period. In the power-on period of Time t1 to t4, the host processor supplies HSYNC_M and HSYNC_S; and the master display driver 10 starts supplying VSYNC_OUT and HSYNC_OUT; and the supplies of the display vertical synchronizing signal DISP_VSYNC and the display horizontal synchronizing signal DISP_HSYNC to the master display driver 10 and the slave display driver 20 are started.

The period of Time t4 to t8 is a gradation reference voltage regulation period of the positive side. In the period of Time t4 to t5, the potentials of control signals of the multiplexer 1 are set to be in a range of 0 V to +VDD by e.g. setting the power source supplied to the input-select-control part 3 in the range of 0 V to +VDD. At Time t5, t6, t7, etc., positive side gradation reference voltages VrefP1, VrefP2, VrefP3, etc. are, sequentially transmitted from the master display driver 10 to the slave display driver 20. In the subsequent period of Time t8 to t9 is a period for well voltage switching. In the master display driver 10, the potentials of control signals of the multiplexer 1 are changed from a voltage of the potential 0 V to +VDD to a voltage of the potential 0 V to −VDD by changing (or switching) the power source supplied to the input-select-control part 3 is changed (switched) from the voltage of 0 V to +VDD to the voltage of 0 V to −VDD, etc. At the time, the well voltage of a pass gate (MOS transistor) included in the multiplexer 1 is changed accompanying the potential change. In the slave display driver 20, the potentials of control signals of the demultiplexer 1 are changed from the range of 0 V to +VDD to the range of 0 V to −VDD by changing (switching) the power source supplied to the output-select-control part 4 from the voltage of 0 V to +VDD to the voltage of 0 V to −VDD, etc. At the time, the well voltage of a pass gate (MOS transistor) included in the demultiplexer 2 is changed accompanying the potential change. In the period of Time t9 to t11 is a gradation reference voltage regulation period of the negative side. At Time t9, t10, etc., the negative side gradation reference voltages VrefN1, VrefN2, etc. are sequentially transmitted from the master display driver 10 to the slave display driver 20. As described above, the positive and negative side gradation reference voltages are transferred from the master display driver 10 to the slave display driver 20 and thus, the master and slave display drivers are allowed to work with the same gradation reference voltages, and at Time t11, a display period is started.

Figure 6:
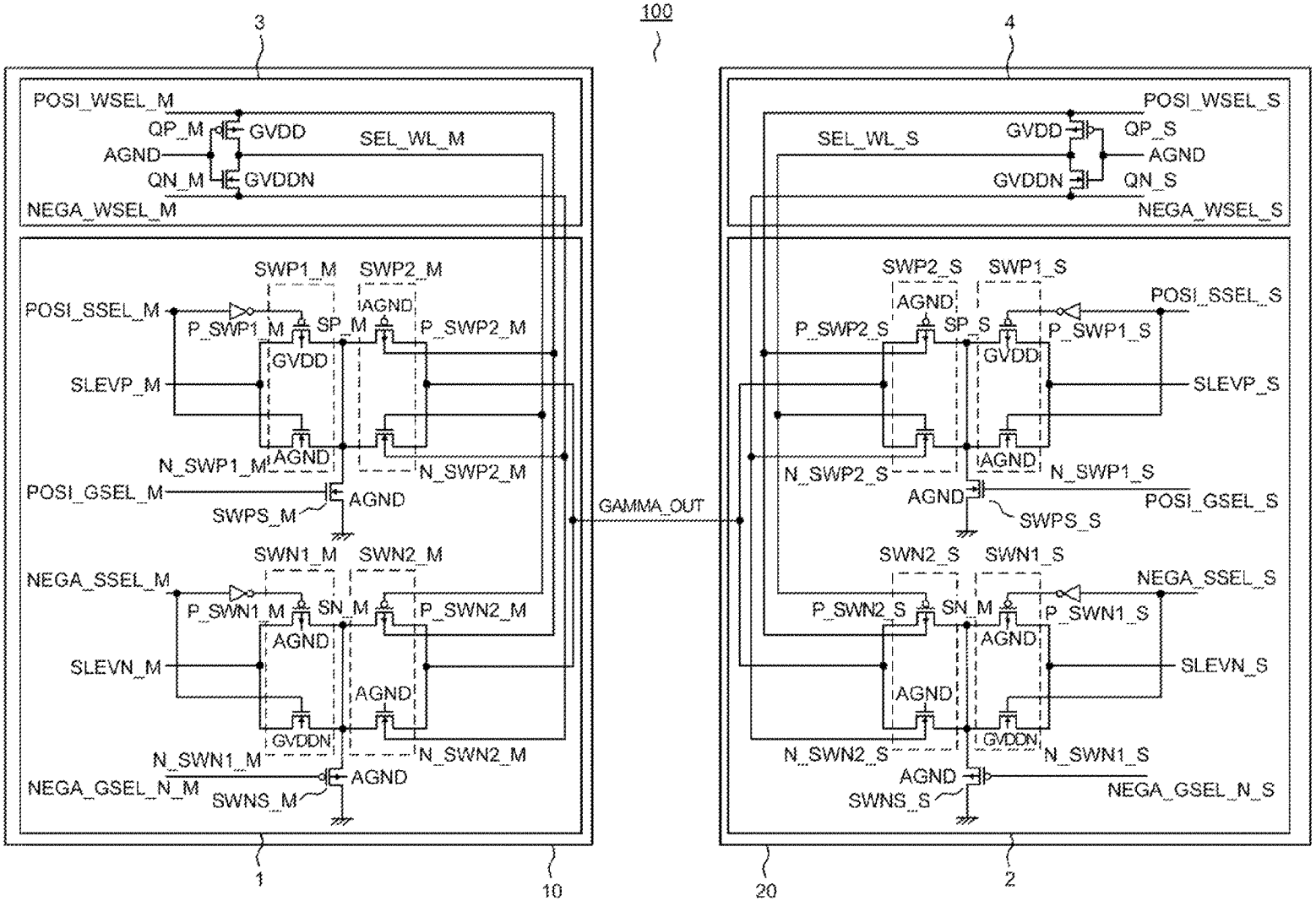
FIG. 6 is a circuit diagram showing an example of the configuration of the voltage transmission circuit according to the invention in detail.

FIG. 6 is a circuit diagram showing an example of the configuration of the voltage transmission circuit 100 according to the invention in detail. The circuits of parts of the multiplexer 1 and input-select-control part 3 of the voltage transmitting circuit 10, and the circuits of parts of the demultiplexer 2 and output-select-control part 4 of the voltage receiving circuit 20 are shown in the diagram. GAMMA_OUT represents a signal line for sending and receiving transmission voltages; the transmitting terminal 5 and the receiving terminal 6 are not shown in the diagram. Here, AGND represents the ground potential, GVDD represents the positive power source, and GVDDN represents the negative power source. For instance, AGND is 0 V, GVDD is +6 V, and GVDDN is −6 V.

In the voltage transmitting circuit 10, positive side gradation voltages are input to the positive side input terminal SLEVP_M of the multiplexer 1 from the positive and negative side gradation-reference-voltage-selecting parts 12_P and 12_N (not shown in FIG. 6, see FIG. 3), and negative side gradation voltages are input to the negative side input terminal SLEVN_M thereof. Between the positive side input terminal SLEVP_M and the output terminal of the multiplexer 1, two CMOS switches SWP1_M and SWP2_M are connected in series; and between the negative side input terminal SLEVN_M and the output terminal, two CMOS switches SWN1_M and SWN2_M are connected in series. To a middle node SP_M of two CMOS switches SWP1_M and SWP2_M of the positive side, a shunt switch SWPS_M which leads to AGND is connected. To a middle node SN_M of the two CMOS switches SWN1_M and SWN2_M of the negative side, a shunt switch SWNS_M which leads to AGND is connected. The CMOS switches SWP1_M and SWN1_M on the input terminal side are controlled in ON/OFF by control signals POSI_SSEL_M and NEGA_SSEL_M respectively. The shunt switches SWPS_M and SWNS_M are controlled in ON/OFF by control signals POSI_GSEL_M and NEGA_GSEL_N_M respectively. The CMOS switches SWP2_M and SWN2_M on the output terminal side are controlled in ON/OFF by controlling, by the input-select-control part 3, the gate terminals of MOS transistors included in the CMOS switches SWP2_M and SWN2_M respectively, and the substrate potential (well potential).

The input-select-control part 3 includes a P channel MOS transistor QP_M and an N channel MOS transistor QN_M. For the P channel MOS transistor and the N channel MOS transistor, the same circuit structure as that of a CMOS inverter is adopted. The gate terminals of the MOS transistors QP_M and QN_M are short-circuited and connected to AGND. The source terminals of the MOS transistors QP_M and QN_M are also short-circuited, which serve to output a control signal SEL_WL_M. The substrate potential (well potential) of the MOS transistor QP_M is connected to GVDD; a control signal POSI_WSEL_M is connected to the drain terminal. The substrate potential (well potential) of the MOS transistor QN_M is connected to GVDDN; a control signal NEGA_WSEL_M is connected to the drain terminal. To the control signal POSI_WSEL_M, either the positive power source GVDD or the ground potential AGND is applied. To the control signal NEGA_WSEL_M, either the ground potential AGND or the negative power source GVDDN is applied.

On the positive side of the multiplexer 1, the gate terminal of a P channel MOS transistor P_SWP2_M included in the CMOS switch SWP2_M closer to the output terminal is connected to AGND, and the well is connected with the control signal POSI_WSEL_M; the gate terminal of an N channel MOS transistor N_SWP2_M is connected with the control signal SEL_WL_M, and the well is connected with the control signal NEGA_WSEL_M. On the negative side, the gate terminal of a P channel MOS transistor P_SWN2_M included in a CMOS switch SWN2_M closer to the output terminal is connected with the control signal SEL_WL_M, and the well is connected with the control signal POSI_WSEL_M; the gate terminal of an N channel MOS transistor N_SWN2_M is connected to AGND, and the well is connected with the control signal NEGA_WSEL_M.

In the voltage receiving circuit 20, the positive output SLEVP_S and negative output SLEVN_S of the demultiplexer 2 are each input to the gradation-reference-voltage-selecting-and-supplying part 21 (not shown in FIG. 6, see FIG. 3). Between the input terminal of the demultiplexer 2, and the positive output SLEVP_S, two CMOS switches SWP2_S and SWP1_S are connected in series; between the input terminal and the negative output SLEVN_S, two CMOS switches SWN2_S and SWN1_S are connected in series. To a middle node SP_S of the two CMOS switches SWP2_S and SWP1_S of the positive side, a shunt switch SWPS_S which leads to AGND is connected. To a middle node SN_S of the two CMOS switches SWN2_S and SWN1_S of the negative side, a shunt switch SWNS_S which leads to AGND is connected. The CMOS switches SWP1_S and SWN1_S on the input terminal side are controlled in ON/OFF by control signals POSI_SSEL_S and NEGA_SSEL_S respectively. The shunt switches SWPS_S and SWNS_S are controlled in ON/OFF by control signals POSI_GSEL_S and NEGA_GSEL_N_S respectively.

The output-select-control part 4 includes a P channel MOS transistor QP_S and an N channel MOS transistor QN_S. For the P channel MOS transistor and the N channel MOS transistor, the same circuit structure as that of a CMOS inverter is adopted. The gate terminals of the MOS transistors QP_S and QN_S are short-circuited and connected to AGND. The source terminals of the MOS transistors QP_S and QN_S are also short-circuited, which serve to output a control signal SEL_WL_S. The substrate potential (well potential) of the MOS transistor QP_S is connected to GVDD; a control signal POSI_WSEL_S is connected to the drain terminal. The substrate potential (well potential) of the MOS transistor QN_S is connected to GVDDN; a control signal NEGA_WSEL_S is connected to the drain terminal. To the control signal POSI_WSEL_S, either the positive power source GVDD or the ground potential AGND is applied. To the control signal NEGA_WSEL_S, either the ground potential AGND or the negative power source GVDDN is applied.

On the positive side of the demultiplexer 2, the gate terminal of a P channel MOS transistor P_SWP2_S included in the CMOS switch SWP2_S closer to the input terminal is connected to AGND, and the well is connected with the control signal POSI_WSEL_S; the gate terminal of an N channel MOS transistor N_SWP2_S is connected with the control signal SEL_WL_S, and the well is connected with the control signal NEGA_WSEL_S. On the negative side, the gate terminal of a P channel MOS transistor P_SWN2_S included in the CMOS switch SWN2_S closer to the input terminal is connected with the control signal SEL_WL_S, and the well is connected with the control signal POSI_WSEL_S; the gate terminal of an N channel MOS transistor N_SWN2_S is connected to AGND, and the well is connected with the control signal NEGA_WSEL_S.

FIGS. 7 and 8 are explanatory diagrams each showing a transmission sequence in the voltage transmission circuit of FIG. 6. The sequence shown in FIG. 7 is a basic transmission sequence consisting of 5 steps, and the sequence shown in FIG. 8 is a transmission sequence consisting of 4 steps. The steps are each represented by Phase; the state of the output of the multiplexer (MUX) 1, the voltage of GAMMA_OUT which is a transmission voltage, and the state of the input to the demultiplexer (DEMUX) 2 are shown in each Phase. In the column for the state of the output of the multiplexer (MUX) 1, ON/OFF state of CMOS switches included in the multiplexer 1 is shown together. In the column for the state of the input of the demultiplexer (DEMUX) 2, and ON/OFF state of CMOS switches included in the demultiplexer 2 is shown together.

In Phase 1, the multiplexer (MUX) 1 is in the state of outputting positive gradation voltages; positive gradation voltages are output as GAMMA_OUT; and the demultiplexer (DEMUX) 2 is in the state of accepting the input of positive gradation voltages.

In Phase 2, the multiplexer (MUX) 1 is in the state of outputting AGND; AGND (0 V) is output as GAMMA_OUT; and the demultiplexer (DEMUX) 2 is in the state of being stopped from accepting the input.

In Phase 3, the multiplexer (MUX) 1 is in the state of being stopped from outputting; GAMMA_OUT is high impedance (HiZ); and the demultiplexer (DEMUX) 2 is in the state of being stopped from accepting the input.

In Phase 4, the multiplexer (MUX) 1 is in the state of outputting AGND; AGND (0 V) is output as GAMMA_OUT; and the demultiplexer (DEMUX) 2 is in the state of being stopped from accepting the input.

In Phase 5, the multiplexer (MUX) 1 is in the state of outputting negative gradation voltages; negative gradation voltages are output as GAMMA_OUT; and the demultiplexer (DEMUX) 2 is in the state of accepting the input of negative gradation voltages.

Phases 2 to 4 form a sequence for averting the transient withstand voltage violation, during which the switching of the well potential is performed. In case that the transmission of positive gradation voltages is required again after Phase 5, the processor executes the sequence for averting the withstand voltage violation formed by Phase 6 identical to Phase 4, Phase 7 identical to Phase 3, and Phase 8 identical to Phase 2 and then, can go back to Phase 9 identical to Phase 1 again, in which the transmission of positive gradation voltages is performed.

The sequence shown in FIG. 8 is a 4-step transmission sequence, in which the above Phase 4 and Phase 8 are skipped. In the 5-step sequence of FIG. 7, the potential of GAMMA_OUT fixed to AGND in Phase 2 can fluctuate during the high-impedance (HiZ) period of Phase 3 and as such, the potential of GAMMA_OUT is fixed to AGND again in Phase 4, but Phase 4 can be skipped on condition that the fluctuation in potential is sufficiently small. If the fluctuation in potential is not large enough to cause the withstand voltage violation, Phase 4 (as well as Phase 8) can be skipped, and the 4-step sequence shown in FIG. 8 can be adopted.

Figure 9:
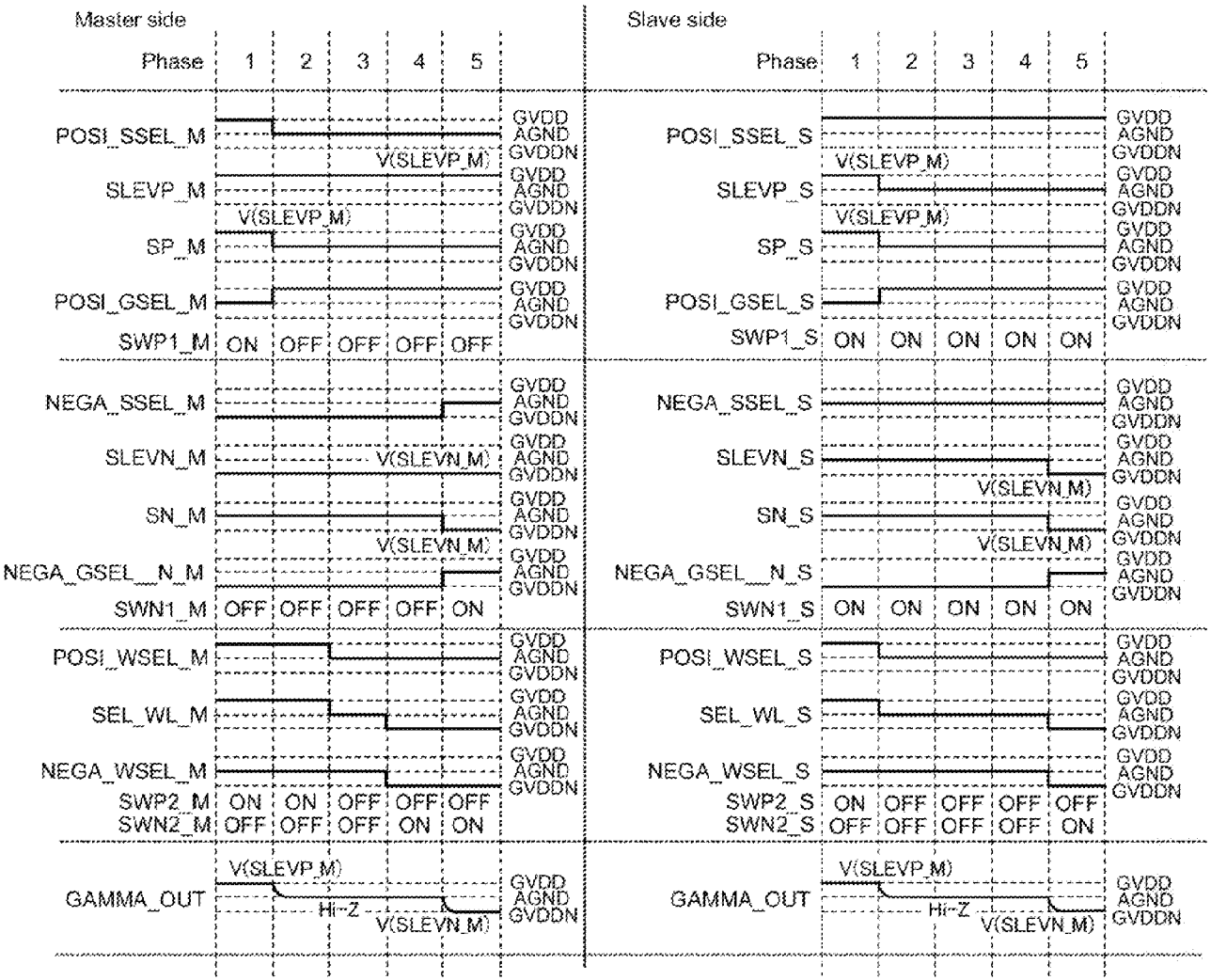
FIG. 9 is a timing diagram showing an example of the transmission sequence in the voltage transmission circuit of FIG. 6.

FIG. 9 is a timing diagram showing an example of the transmission sequence in the voltage transmission circuit of FIG. 6. The left portion of the diagram shows control signals and node voltages in connection with the switches included in the multiplexer 1 on the side of the voltage transmitting circuit 10; and the right portion shows control signals and node voltages in connection with the switches included in the demultiplexer 2 on the side of the voltage receiving circuit 20. In the diagram, the respective Phases are shown along a horizontal axis direction; the control signals and node voltages in connection with the switches SWP1_M, SWN1_M, SWP2_M and SWN2_M, and GAMMA_OUT are shown in a vertical axis direction on the side of the voltage transmitting circuit 10 (i.e. the left side) from the top in turn; and the control signals and node voltages in connection with the switches SWP1_S, SWN1_S, SWP2_S and SWN2_S, and GAMMA_OUT are shown in a vertical axis direction on the side of the voltage receiving circuit 20 (i.e. the right side) from the top in turn.

Figure 10:
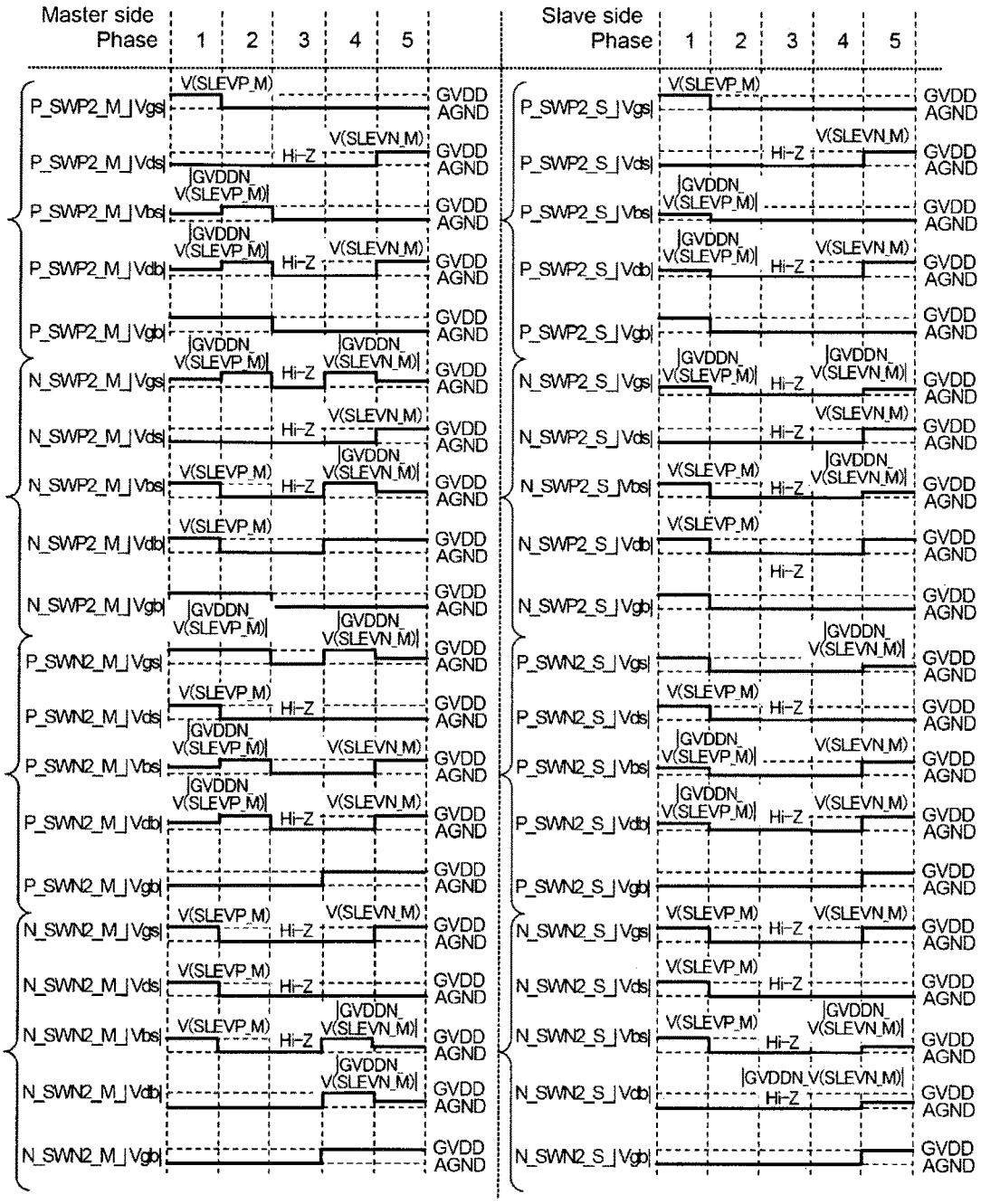
FIG. 10 is a timing diagram showing voltages applied to the elements in the transmission sequence of FIG. 9.

FIG. 10 is a timing diagram showing voltages applied to the elements in the transmission sequence of FIG. 9. Here, the elements shown in FIG. 10 are pass gates (MOS transistors) which form the CMOS switches of the multiplexer 1 on the side of the voltage transmitting circuit 10 (master), and the demultiplexer 2 on the side of the voltage receiving circuit 20 (slave), including the pass gates P_SWP2_M and N_SWP2_M included in the switch SWP2_M, the pass gates P_SWN2_M and N_SWN2_M included in the switch SWN2_M, the pass gates P_SWP2_S and N_SWP2_S included in the switch SWP2_S, and the pass gates P_SWN2_S and N_SWN2_S included in the switch SWN2_S. The following are shown in the diagram for the respective pass gates (MOS transistors): the voltage Vgs between a gate and a source; the voltage Vds between a drain and a source; the voltage Vbs between a substrate (well) and a source; the voltage Vdb between a drain and a substrate (well); and the voltage Vgb between a gate and a substrate (well).

The actions in the respective Phases will be described below in detail. It is noted that "V(SIGNAL)" refers to a voltage on a signal line SIGNAL.

Phase 1: Positive gradation reference voltage transmission (from SLEVP_M to SLEVP_S)

1. Making the control signal POSI_SSEL_M GVDD, and POSI_GSEL_M AGND on the side of the voltage transmitting circuit 10 (master), the switch SWP1_M is put in electrical conduction, the voltage V(SLEVP_M) of the signal line SLEVP_M to which positive side voltages targeted for transmission are input is transmitted to the middle node SP_M. At the time, the control signal NEGA_SSEL_M is made GVDDN, and the control signal NEGA_GSEL_N_M is made GVDDN, whereby the switch SWN1_M is turned off, and the middle node SN_M is discharged (shunted) to AGND.

2. Making the control signal POSI_WSEL_M GVDD, and the control signal NEGA_WSEL_M AGND on the side of the voltage transmitting circuit 10 (master), SEL_WL_M becomes GVDD, the switch SWP2_M is brought into electrical conduction, and the SWN2_M is turned off. Thus, the voltage V(SLEVP_M) is transmitted to GAMMA_OUT through the middle node SP_M.

3. Making the control signal POSI_WSEL_S GVDD, and the control signal NEGA_WSEL_S AGND on the side of the voltage receiving circuit 20 (slave), the control signal SEL_WL_S becomes GVDD, the switch SWP2_S is brought into electrical conduction; and the switch SWN2_S is turned off. Thus, the voltage V(SLEVP_M) is transmitted from GAMMA_OUT to the middle node SP_S.

4. Making the control signal POSI_SSEL_S GVDD, and the control signal POSI_GSEL_S AGND on the side of the voltage receiving circuit 20 (slave), the switch SWP1_S is brought into electrical conduction, the voltage V(SLEVP_M) is transmitted from GAMMA_OUT to the positive output SLEVP_S through the middle node SP_S. At the time, the control signal NEGA_SSEL_S is made AGND, and the control signal NEGA_GSEL_N_S is made GVDDN, whereby the switch SWN1_S is brought into electrical conduction; the middle node SN_S is discharged to AGND and in parallel, and the negative output SLEVN_S is made AGND level.

5. According to the above, the voltage V(SLEVP_M) is transmitted from the positive input SLEVP_M to SLEVP_S. At the time, as shown by FIG. 10, the inter-terminal voltage never exceeds GVDD-AGND in pass gates (MOS transistors) included in the multiplexer 1 on the side of the voltage transmitting circuit 10 (master), and the demultiplexer 2 on the side of the voltage receiving circuit 20 (slave) respectively. While the voltage V(SLEVN_M) is GVDDN which is a voltage targeted for transmission on the negative side on the side of the voltage transmitting circuit 10 (master), the switch SWN1_M is turned off, the middle node SN_M is discharged (shunted) to AGND and therefore, only a voltage, at most, of AGND−GVDDN=GVDD is applied to between electrodes of each of pass gates (MOS transistors) included in the switch SWN1_M, and only a voltage, at most, of GVDD−AGND=GVDD is applied to between electrodes of each of pass gates (MOS transistors) included in the switch SWN2_M. In addition, on the side of the voltage receiving circuit 20 (slave), the switch SWN1_S is put in electrical conduction, the middle node SN_S is discharged to AGND, and the negative output SLEVN_S is at AGND level. Therefore, as to the switches SW1N_S and SW2N_S for transmitting GVDDN which is a voltage targeted for transmission on the negative side, even in the condition that the demultiplexer 2 is transmitting GVDD which is a voltage targeted for transmission of the positive side, only a voltage, at most, of GVDD-AGND=GVDD is applied to between electrodes of each of pass gates (MOS transistors) included in the switches SW1N_S and SW2N_S.

Phase 2: Sequence 1 for averting the withstand voltage violation (with V(GAMMA_OUT) fixed to AGND)

1. Making the control signal POSI_SSEL_M AGND and the control signal POSI_GSEL_M GVDD on the side of the voltage transmitting circuit 10 (master), the switch SWP1_M is turned off, and the signal line SP_M is discharged to AGND. Besides, the switch SWN1_M remains off. At the time, the control signal NEGA_SSEL_M remains at GVDDN, and the control signal NEGA_GSEL_N_M remains at GVDDN and as such, the switch SWN1_M is off, and the middle node SN_M remains discharged to AGND.

2. The control signal POSI_WSEL_M on the side of the voltage transmitting circuit 10 (master) is at GVDD, and the control signal NEGA_WSEL_M remains at AGND. Therefore, SEL_WL_M is at GVDD; the switch SWP2_M is put in electrical conduction; and the switch SWN2_M is turned off. Thus, AGND level at the middle node SP_M is transmitted to GAMMA_OUT.

3. The control signal POSI_WSEL_S on the side of the voltage receiving circuit 20 (slave) is turned to AGND, and the control signal NEGA_WSEL_S remains at AGND, whereby the control signal SEL_WL_S is turned to AGND; the switches SWP2_S and SWN2_S are both turned off.

4. The control signal POSI_SSEL_S on the side of the voltage receiving circuit 20 (slave) remains at GVDD, and the control signal POSI_GSEL_S is turned to GVDD, whereby the switch SWP1_S remains in electrical conduction, the middle node SP_S is discharged to AGND, and the positive output SLEVP_S is turned to AGND level. At the time, the control signal NEGA_SSEL_S remains at AGND, and the control signal NEGA_GSEL_N_S remains at GVDDN, whereby the switch SWN1_S is put in electrical conduction, the middle node SN_S remains discharged at AGND, and therefore the negative output SLEVN_S also remains at AGND level.

5. According to the above, the voltage V(GAMMA_OUT) is discharged to AGND, whereby the withstand voltage violation in Phase 3 is averted.

Phase 3: Sequence 2 for averting the withstand voltage violation. (Making V(GAMMA_OUT) Hi-Z, and causing V(SEL_WL_M) to shift to AGND)

1. The control signal POSI_SSEL_M on the side of the voltage transmitting circuit 10 (master) remains at AGND, and the control signal POSI_GSEL_M also remains at GVDD, whereby the switch SWP1_M remains off, and the signal line SP_M is discharged to AGND. At the time, the control signal NEGA_SSEL_M remains at GVDDN, and the control signal NEGA_GSEL_N_M also remains at GVDDN, whereby the switch SWN1_M is turned off, and the middle node SN_M is discharged to AGND.

2. The control signal POSI_WSEL_M on the side of the voltage transmitting circuit 10 (master) is made AGND, the control signal NEGA_WSEL_M remains at AGND, whereby SEL_WL_M is turned to AGND, the switches SWP2_M and SWN2_M are both turned off. Thus, GAMMA_OUT is brought into Hi-Z state.

3. The control signal POSI_WSEL_S on the side of the voltage receiving circuit 20 (slave) remains at AGND, the control signal NEGA_WSEL_S also remains at AGND and therefore, the control signal SEL_WL_S is at AGND level, and the switches SWP2_S and SWN2_S both remain off.

4. The control signal POSI_SSEL_S on the side of the voltage receiving circuit 20 (slave) remains at GVDD, and the control signal POSI_GSEL_S also remains at GVDD and therefore, the switch SWP1_S remains in electrical conduction, the middle node SP_S is discharged to AGND, and the positive output SLEVP_S is at AGND level. At the time, the control signal NEGA_SSEL_S remains at AGND, and the control signal NEGA_GSEL_N_S remains at GVDDN, whereby the switch SWN1_S remains in electrical conduction, and the middle node SN_S remains discharged at AGND and therefore, the negative output SLEVN_S also remains at AGND level.

5. According to the above, the well voltage V(SEL_WL_M) of a pass gate circuit on the side of the voltage transmitting circuit 10 (master) is caused to shift to AGND.

Phase 4: Sequence 3 for averting the withstand voltage violation. (With V(GAMMA_ OUT) fixed at AGND, and causing V(SEL_WL_M) to shift to GVDDN)

1. The control signal POSI_SSEL_M on the side of the voltage transmitting circuit 10 (master) remains at AGND, and the control signal POSI_GSEL_M also remains at GVDD, whereby the switch SWP1_M is turned off, and the signal line SP_M is discharged to AGND. At the time, the control signal NEGA_SSEL_M remains at GVDDN, the control signal NEGA_GSEL_N_M also remains at GVDDN, whereby the switch SWN1_M is turned off, and the middle node SN_M is discharged to AGND.

2. The control signal POSI_WSEL_M on the side of the voltage transmitting circuit 10 (master) remains at AGND, and NEGA_WSEL_M is turned to GVDDN, whereby SEL_WL_M is turned to GVDDN, the switch SWP2_M is turned off, and the switch SWN2_M is brought into electrical conduction. Thus, AGND level at the middle node SP_N is transmitted to GAMMA_OUT.

3. The control signal POSI_WSEL_S on the side of the voltage receiving circuit 20 (slave) remains at AGND, and the control signal NEGA_WSEL_S also remains at AGND and thus, the control signal SEL_WL_S is at AGND level, and the switches SWP2_S and SWN2_S both remain off.

4. The control signal POSI_SSEL_S on the side of the voltage receiving circuit 20 (slave) remains at GVDD, the control signal POSI_GSEL_S also remains at GVDD and thus, the switch SWP1_S remains in electrical conduction, the middle node SP_S remains discharged at AGND and the positive output SLEVP_S is at AGND level. At the time, the control signal NEGA_SSEL_S remains at AGND, and the control signal NEGA_GSEL_N_S remains at GVDDN and thus, the switch SWN1_S remains in electrical conduction, the middle node SN_S remains discharged at AGND. Therefore, the negative output SLEVN_S also remains at AGND level.

5. According to the above, with the voltage V(GAMMA_OUT) fixed at AGND, the well voltage V(SEL_WL_M) of a pass gate circuit on the side of the voltage transmitting circuit 10 (master) is caused to shift to GVDDN.

Phase 5: Negative gradation reference voltage transmission (from SLEVN_M to SLEVN_S)

1. The control signal POSI_SSEL_M on the side of the voltage transmitting circuit 10 (master) remains at AGND, POSI_GSEL_M remains at GVDD and thus, the switch SWP1_M is off, the signal line SP_M is discharged to AGND. At the time, NEGA_SSEL_M is turned to AGND, NEGA_GSEL_N_M is also turned to AGND and thus, the switch SWN1_M is put in electrical conduction, and the voltage V(SLEVN_M) on the signal line SLEVN_M is transmitted to SN_M.

2. The control signal POSI_WSEL_M on the side of the voltage transmitting circuit 10 (master) remains at AGND, NEGA_WSEL_M remains at GVDDN and therefore, SEL_WL_M is at GVDDN, the switch SWP2_M is off, but SWN2_M is put in electrical conduction. Thus, the voltage V(SLEVN_M) is transmitted to GAMMA_OUT through SN_M.

3. The control signal POSI_WSEL_S on the side of the voltage receiving circuit 20 (slave) remains at AGND, and NEGA_WSEL_S is turned to GVDDN, whereby SEL_WL_S is turned to GVDDN level, the switch SWP2_S is off, and SWN2_S is brought into electrical conduction. Thus, V(SLEVN_M) is transmitted from GAMMA_OUT to SN_S.

4. The control signal POSI_SSEL_S on the side of the voltage receiving circuit 20 (slave) remains at GVDD, and POSI_GSEL_S remains at GVDD and thus, the switch SWP1_S remains in electrical conduction, SP_S remains discharged at AGND, and SLEVP_S is at AGND level. At the time, NEGA_SSEL_S remains at AGND, and NEGA_GSEL_N_S is turned to AGND, whereby the switch SWN1_S remains in electrical conduction, and AGND discharge at SN_S is stopped. Thus, V(SLEVN_M) is transmitted from GAMMA_OUT to SLEVN_S through SN_S.

5. According to the above, V(SLEVN_M) is transmitted from SLEVN_M to SLEVN_S. At the time, as shown in FIG. 10, the inter-terminal voltages never exceed GVDD-AGND in pass gates (MOS transistors) which the multiplexer 1 on the side of the voltage transmitting circuit 10 (master), and the demultiplexer 2 on the side of the voltage receiving circuit 20 (slave) include respectively. While on the side of the voltage transmitting circuit 10 (master), V(SLEVIP_M) is made GVDD which is a voltage targeted for transmission on the positive side, the switch SWP1_M is off and SP_M is discharged (shunted) to AGND and as such, only a voltage, at most, of GVDD-AGND=GVDD is applied to between electrodes of each of pass gates (MOS transistors) included in the switch SWP1_M, and only a voltage, at most, of AGND-GVDDN=GVDD is applied to between electrodes of each of pass gates (MOS transistors) included in the switch SWN2_M. In addition, on the side of the voltage receiving circuit 20 (slave), the switch SWP1_S is in electrical conduction, SP_S is discharged at AGND, and SLEVP_S is at AGND level and therefore, even when the demultiplexer 2 is transmitting GVDDN which is a voltage targeted for transmission on the negative side, only a voltage, at most, of AGND-GVDDN=GVDD is applied to between electrodes of each of pass gates (MOS transistors) included in the switches SW1P_S and SW2P_S for transmitting GVDD which is a voltage targeted for transmission on the positive side.

As described above, the process of transition of Phase 1 to Phase 5 is controlled so that the inter-terminal voltage of each of pass gates (MOS transistors) which the multiplexer and the demultiplexer 2 include never exceeds GVDD−AGND=AGND−GVDDN=GVDD, by causing the amplitude of control signals to shift from the difference between GVDD and AGND to the difference between AGND and GVDDN and in parallel, appropriately causing a substrate (well) voltage to shift from the potential difference between GVDD and AGND to that between AGND and GVDDN as the voltage targeted for transmission changes from GVDD of positive polarity to GVDDN of negative polarity. In Phases 2 to 4 in the course of the process, control can be performed so as not to cause the withstand voltage violation owing to the interference by a voltage targeted for transmission remaining in a middle node or the like when the potential of each node to which a voltage targeted for transmission is applied is forcibly changed to AGND once, whereby the amplitude of control signals is caused to shift from the difference between GVDD and AGND to the difference between AGND and GVDDN, and the substrate (well) voltage is caused to appropriately shift from GVDD to AGND, and from AGND to GVDDN.

Thus, the withstand voltage of each of pass gates (MOS transistors) which the multiplexer 1 and the demultiplexer 2 include can be made a withstand voltage which achieves resistance against a voltage having, as an absolute value, of |GVDD| and |GVDDN|, larger one.

Figure 11:
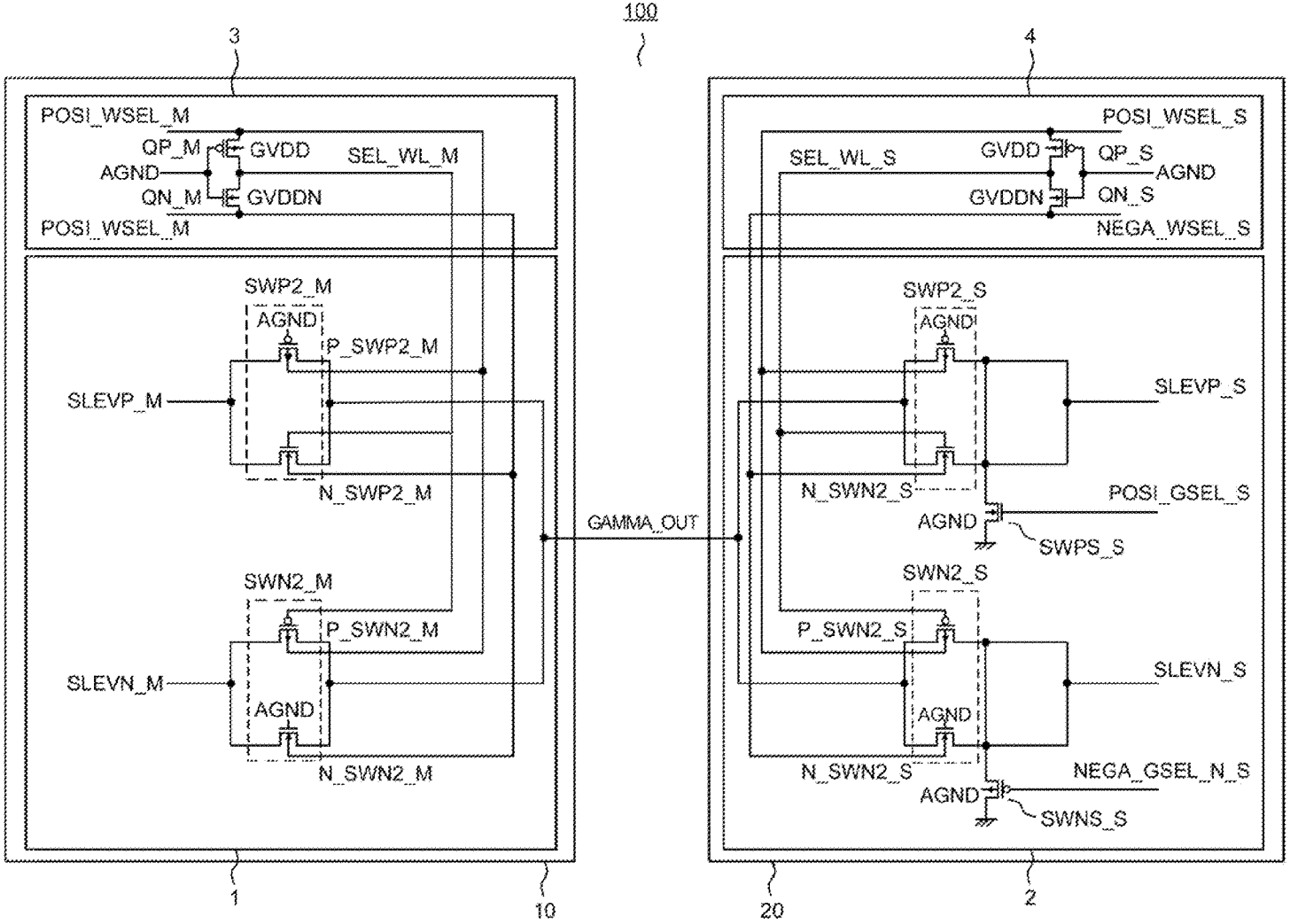
FIG. 11 is a circuit diagram showing another example of the configuration of the voltage transmission circuit according to the invention in detail.

FIG. 11 is a circuit diagram showing another example of the configuration of the voltage transmission circuit 100 according to the invention in detail. In the diagram, there are shown a multiplexer 1 and a circuit of part of an input-select-control part 3 which a voltage transmitting circuit 10 includes, and a demultiplexer 2 and a circuit of part of an output-select-control part 4 which a voltage receiving circuit 20 includes, as in FIG. 6 showing the voltage transmission circuit 100. The voltage transmission circuit 100 here is different from the voltage transmission circuit 100 shown in FIG. 6 in that the CMOS switches SWP1_M and SWN1_M, and the shunt switches SWPS_M and SWNS_M are omitted in the multiplexer 1, and the CMOS switches SWP1_S and SWN1_S are omitted in the demultiplexer 2. Other parts of the configuration thereof are the same as those in the voltage transmission circuit 100 according to what is shown in FIG. 6 and therefore, their descriptions are skipped here.

Figure 12:
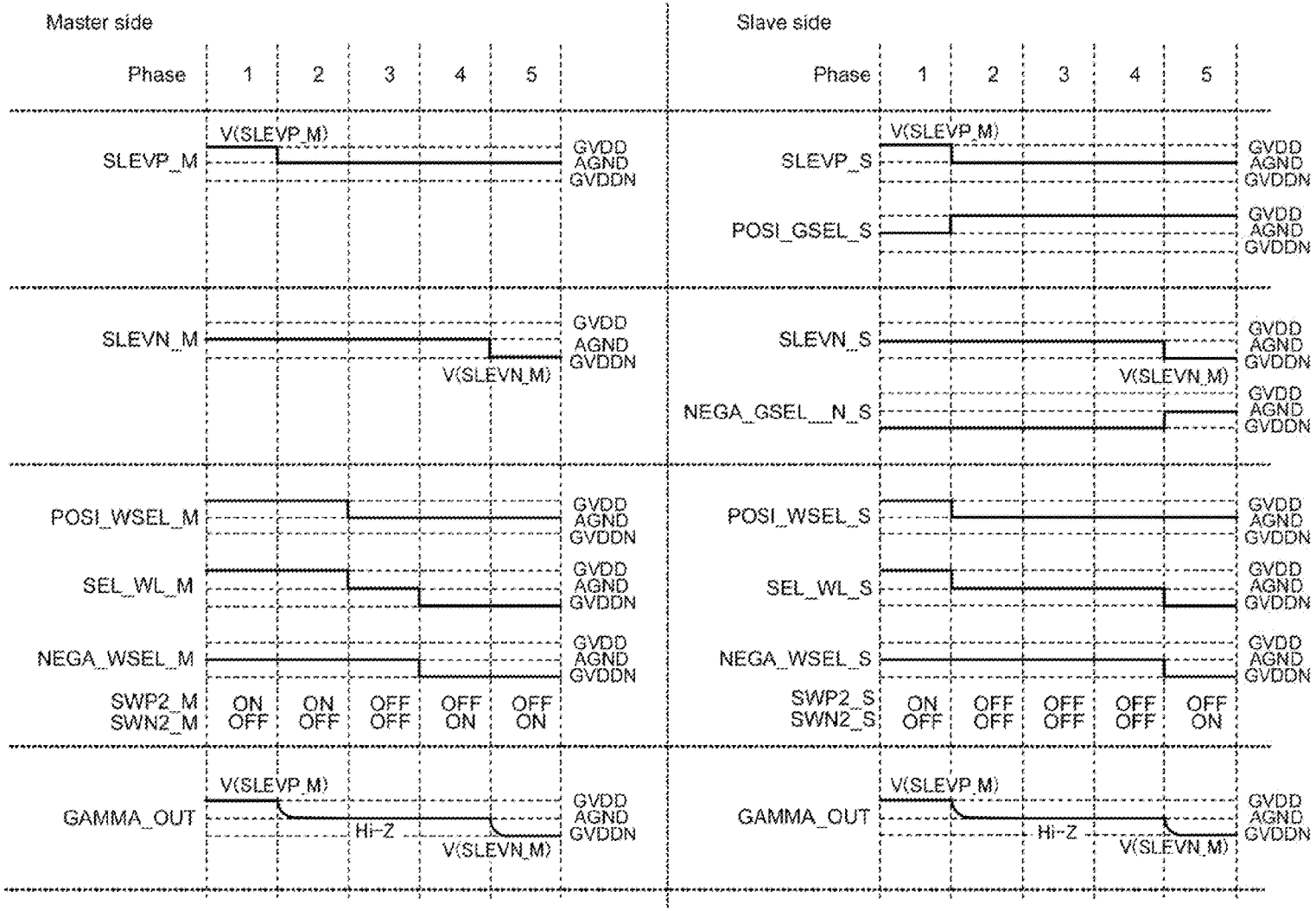
FIG. 12 is a timing diagram showing an example of the transmission sequence in the voltage transmission circuit of FIG. 11.

FIG. 12 is a timing diagram showing an example of a transmission sequence used for the voltage transmission circuit 100 shown in FIG. 11. As in the case of the transmission sequence of FIG. 9, the left portion of the diagram shows control signals and node voltages in connection with switches included in the multiplexer 1 on the side of the voltage transmitting circuit 10; and the right portion shows control signals and node voltages in connection with the switches included in the demultiplexer 2 on the side of the voltage receiving circuit 20. In the diagram, the respective Phases are shown along a horizontal axis direction; the control signals and node voltages in connection with the switches SWP2_M and SWN2_M, and GAMMA_OUT are shown in a vertical axis direction on the side of the voltage transmitting circuit 10 (i.e. the left side) from the top in turn; and the control signals and node voltages in connection with the switches SWP2_S and SWN2_S, and GAMMA_OUT are shown in a vertical axis direction on the side of the voltage receiving circuit 20 (i.e. the right side) from the top in turn.

In the embodiment shown in FIG. 6, the voltage V(SLEVP_M) targeted for transmission on the positive side, and the voltage V(SLEVN_M) targeted for transmission on the negative side are fixed respectively, whereas here the voltages V(SLEVP_M) and V(SLEVN_M) are caused to transition to AGND (0 V) in the Phases except those in which the voltages are transmitted. In the case of supplying the voltages V(SLEVP_M) and V(SLEVN_M) which are targeted for transmission from the gradation-reference-voltage-selecting parts 12_P and 12_N shown in FIG. 3, for example, the voltage selected and output in a period other than a period targeted for transmission is made AGND (0 V) by controlling the gradation-reference-voltage-selecting parts 12_P and 12_N. The other actions are the same as what has been described with reference to FIG. 9.

Adopting the configuration shown in FIG. 11 has the same effect and advantage as achieved by the configuration shown in FIG. 6 can be obtained while arranging the multiplexer 1 and the demultiplexer 2 in a smaller circuit scale in comparison to that in FIG. 6.

While the invention made by the inventor has been concretely described above based on the embodiments, the invention is not limited them. It is obvious that various changes or modifications may be made without departing from the subject matter hereof.

For example, the potentials are each just a relative quantity, and they can be changed without departing from the subject matter of the invention. Even if they are caused to shift to 2VDD, VDD, 0 V and the like with the relative relation thereof retained, and the resultant potentials are used instead of the positive power source (+VDD), the ground potential (0 V), the negative power source (−VDD), exactly the same effect and advantage can be achieved.

What is claimed is:

1. A voltage transmission circuit comprising:

a multiplexer configured to receive an analog positive voltage higher than a ground potential and an analog negative voltage lower than the ground potential; and a demultiplexer having a positive output and a negative output;

wherein, in transmitting the analog positive voltage from the multiplexer to the demultiplexer:

the multiplexer receives the analog positive voltage at a first input while being blocked from receiving the analog negative voltage at a second input of the multiplexer, and transmits the analog positive voltage to the demultiplexer in response to first multiplexer-control signals each having a voltage potential within a range from the ground potential to a positive power source voltage, and wherein the demultiplexer outputs from the positive output the analog positive voltage received from the multiplexer, and outputs from the negative output the ground potential in response to first demultiplexer-control signals each having a voltage potential within a range from the ground potential to the positive power source voltage, and wherein, in transmitting the analog negative voltage from the multiplexer to the demultiplexer:

the multiplexer receives the analog negative voltage at the second input while being blocked from receiving the analog positive voltage at the first input, and outputs the analog negative voltage to the demultiplexer in response to second multiplexer-control signals each having a voltage potential within a range from a negative power source voltage to the ground potential, and the demultiplexer outputs from the negative output the analog negative voltage received from the multiplexer and outputs from the positive output the ground potential in response to second demultiplexer-control signals each having a voltage potential within a range from the negative power source voltage to the ground potential.

2. The voltage transmission circuit according to claim 1, wherein, in transmitting the analog negative voltage after transmitting the analog positive voltage, before transmitting the analog negative voltage, the multiplexer is blocked from receiving the analog positive voltage, the first multiplexer-control signals are each switched to the second multiplexer-control signals, and the multiplexer outputs the ground potential to the demultiplexer, and the first demultiplexer-control signals are switched to the second multiplexer-control signals, and the demultiplexer outputs the ground potential from the positive output.

3. The voltage transmission circuit according to claim 1, wherein, in transmitting the positive voltage after transmitting the negative voltage, before transmitting the positive voltage:

the multiplexer is blocked from the negative voltage, the multiplexer-control signals are each switched to a voltage potential within the range of the ground potential to the positive power source voltage, the multiplexer outputs the ground potential to the demultiplexer in response to the switched multiplexer-control signals, the demultiplexer-control signals are each switched to a voltage potential within the range from the ground potential to the positive power source voltage, and the demultiplexer is configured to output the ground potential from the negative output.

4. The voltage transmission circuit according to claim 1, further comprising:

an input select controller configured to receive the positive power source voltage, the negative power source voltage, and the ground potential and transmit the first and second multiplexer control signals to the multiplexer; and an output select controller configured to receive the positive power source voltage, the negative power source voltage, and the ground potential and transmit the first and second demultiplexer control signals to the demultiplexer.

5. The voltage transmission circuit according to claim 4, wherein after transmitting the ground potential, the first demultiplexer-control signals are switched to the second demultiplexer-control signals.

6. The voltage transmission circuit according to claim 4, wherein the first demultiplexer-control signals are switched to the second demultiplexer-control signals, and the positive output of the demultiplexer is shunted to the ground potential.

7. The voltage transmission circuit according to claim 1, wherein after transmitting the analog positive voltage and before transmitting the analog negative voltage, the multiplexer is blocked from receiving the analog positive voltage, the first and second inputs of the multiplexer are shunted to the ground potential, and the multiplexer transmits the ground potential to the demultiplexer.

8. A voltage transmission circuit comprising:

at least one transmitting circuit; and at least one receiving circuit, wherein the at least one transmitting circuit comprises:

a multiplexer configured to receive a positive voltage higher than a ground potential and a negative voltage lower than the ground potential;

a transmitting terminal, wherein the at least one receiving circuit comprises:

a receiving terminal;

a demultiplexer having a positive output and a negative output, wherein, in transmitting the positive voltage from the multiplexer to the demultiplexer:

the multiplexer transmits the positive voltage to the demultiplexer, the demultiplexer-control signals each have a voltage potential within the range from the ground potential to the positive power source voltage, and the demultiplexer outputs from the positive output the positive voltage received from the multiplexer and outputs from the negative output the ground potential, and wherein, in transmitting the negative voltage from the multiplexer to the demultiplexer:

the multiplexer outputs the negative voltage to the demultiplexer, and the demultiplexer outputs from the negative output the negative voltage received from the multiplexer and outputs from the positive output the ground potential, wherein the multiplexer includes a first CMOS switch to which the positive voltage can be input and is connected with the transmitting terminal, and a second CMOS switch to which the negative voltage can be input and is connected with the transmitting terminal, the demultiplexer includes a third CMOS switch connected between the receiving terminal and the positive output, and a fourth CMOS switch connected between the receiving terminal and the negative output, the at least one transmitting circuit is configured to control well potentials of MOS transistors constituting the first and second CMOS switches with multiplexer-control signals, respectively, and the at least one receiving circuit is configured to control well potentials of MOS transistors constituting the third and fourth CMOS switches with demultiplexer-control signals, respectively.

9. The voltage transmission circuit according to claim 8, wherein the multiplexer further comprises: a fifth CMOS switch connected between the positive voltage and the first CMOS switch; a first shunt switch by which a connection node of the first CMOS switch and the fifth CMOS switch can be short-circuited to the ground potential; a sixth CMOS switch connected between the negative voltage and the second CMOS switch; and a second shunt switch by which the connection node of the second CMOS switch and the sixth CMOS switch can be short-circuited to the ground potential, and the demultiplexer further comprises: a seventh CMOS switch connected between the third CMOS switch and the positive output; a third shunt switch by which the connection node of the third CMOS switch and the seventh CMOS switch can be short-circuited to the ground potential; an eighth CMOS switch connected between the fourth CMOS switch and the negative output; and a fourth shunt switch by which the connection node of the fourth CMOS switch and the eighth CMOS switch can be short-circuited to the ground potential.

10. The voltage transmission circuit according to claim 8, wherein a number of the at least one transmitting circuit is one, and a number of the at least one receiving circuit is more than one.

11. The voltage transmission circuit according to claim 8, wherein the at least one transmitting circuit and the at least one receiving circuit are formed as integrated circuits on different semiconductor substrates respectively.

12. The voltage transmission circuit according to claim 8, wherein the at least one transmitting circuit further comprises a gradation-reference-voltage-generating part, and a gradation-reference-voltage-selecting part, the gradation-reference-voltage-generating part is configured to generate positive side gradation reference voltages higher than the ground potential, and negative side gradation reference voltages lower than the ground potential, the gradation-reference-voltage-selecting part is configured to select one of the positive side gradation reference voltages, and supply the multiplexer with the selected positive side gradation reference voltage as the positive voltage, and select one of the negative side gradation reference voltages, and supply the multiplexer with the selected negative side gradation reference voltage as the negative voltage, the at least one receiving circuit further comprises: a gradation-reference-voltage-selecting-and-supplying part; a gradation-reference-voltage-holding-and-generating part; and a source line activation part, the gradation-reference-voltage-selecting-and-supplying part is configured to supply positive or negative voltages output by the demultiplexer to the gradation-reference-voltage-holding-and-generating part, the gradation-reference-voltage-holding-and-generating part comprises a gradation-reference-voltage-holding part including voltage-holding circuits, and is configured to hold, as gradation reference voltages, positive or negative voltages supplied from the gradation-reference-voltage-selecting-and-supplying part in the voltage-holding circuits, and produce gradation voltages based on the gradation reference voltages, and the source line activation part is configured to activate source lines of a display panel based on the gradation voltages.

13. The voltage transmission circuit according to claim 12, wherein, in transmitting the positive side gradation reference voltages, the at least one transmitting circuit is configured to use the gradation-reference-voltage-selecting part to sequentially select, from the positive side gradation reference voltages, one at a time, and the selected positive side gradation reference voltage is sent from the multiplexer as the positive voltage, wherein, in transmitting the negative side gradation reference voltages, the at least one transmitting circuit is configured to use the gradation-reference-voltage-selecting part to sequentially select, from the negative side gradation reference voltages, one at a time, and the selected negative side gradation reference voltage is sent from the multiplexer as the negative voltage, and the at least one receiving circuit is configured to use the gradation-reference-voltage-selecting-and-supplying part to sequentially supply the voltage-holding circuits with positive or negative voltages output by the demultiplexer, wherein the voltage-holding circuits are configured to hold the positive or negative voltages.

14. The voltage transmission circuit according to claim 13, wherein, in transmitting negative side gradation reference voltages after transmitting positive side gradation reference voltages, before transmitting the negative side gradation reference voltages:

the multiplexer-control signals are each switched to a voltage potential within the range from a negative power source voltage to the ground potential, and the multiplexer outputs the ground potential to the demultiplexer in response to the switched multiplexer-control signals, the demultiplexer-control signals are each switched to a voltage potential within the range from the negative power source voltage to the ground potential, and the demultiplexer outputs the ground potential from the positive output in response to the switched demultiplexer-control signals.

15. The voltage transmission circuit according to claim 13, wherein, in transmitting the positive side gradation reference voltages after transmitting the negative side gradation reference voltages, before transmitting the positive side gradation reference voltages:

the multiplexer is blocked from the negative voltage, the multiplexer-control signals are each switched to a voltage potential within the range of the ground potential to the positive power source voltage, the multiplexer outputs the ground potential to the demultiplexer in response to the switched multiplexer-control signals, the demultiplexer-control signals are switched to voltage potentials within the range of the ground potential to the positive power source voltage, and the demultiplexer is configured to output the ground potential from the negative output.

16. A voltage transmitting circuit comprising:

a multiplexer configured to receive a positive voltage higher than a ground potential, and a negative voltage lower than the ground potential, and send a transmission voltage selected from the positive and negative voltages to a voltage receiving circuit;

a transmitting terminal, wherein, in sending the positive voltage as the transmission voltage:

the multiplexer transmits the positive voltage to a demultiplexer, and wherein, in sending the negative voltage as the transmission voltage:

the multiplexer outputs the negative voltage to the demultiplexer, wherein the multiplexer includes a first CMOS switch to which the positive voltage can be input and is connected with the transmitting terminal, and a second CMOS switch to which the negative voltage can be input and is connected with the transmitting terminal, and wherein the voltage transmitting circuit is configured to control well potentials of MOS transistors constituting the first and second CMOS switches with multiplexer-control signals.

17. The voltage transmitting circuit according to claim 16, further comprising:

a gradation-reference-voltage-generating part; and a gradation-reference-voltage-selecting part, wherein the gradation-reference-voltage-generating part is configured to generate positive side gradation reference voltages higher than the ground potential, and negative side gradation reference voltages lower than the ground potential, the gradation-reference-voltage-selecting part is configured to select one of the positive side gradation reference voltages, and supply the multiplexer with the selected positive side gradation reference voltage as the positive voltage, and is configured to select one of the negative side gradation reference voltages, and supply the multiplexer with the selected negative side gradation reference voltage as the negative voltage.

18. The voltage transmitting circuit according to claim 17, wherein, in transmitting the positive side gradation reference voltages, the gradation-reference-voltage-selecting part is configured to sequentially select, from the positive side gradation reference voltages, one at a time, and the selected positive side gradation reference voltage is sent from the multiplexer as the positive voltage, and wherein, in transmitting the negative side gradation reference voltages, the gradation-reference-voltage-selecting part is configured to sequentially select, from the negative side gradation reference voltages, one at a time, and the selected negative side gradation reference voltage is sent from the multiplexer as the negative voltage.

19. The voltage transmitting circuit according to claim 18, wherein, in transmitting negative side gradation reference voltages after transmitting positive side gradation reference voltages, before transmitting the negative side gradation reference voltages, the multiplexer-control signals are each switched to a voltage potential within the range from the negative power source voltage to the ground potential, and the multiplexer outputs the ground potential to the demultiplexer in response to the switched multiplexer-control signals, and wherein, in transmitting positive side gradation reference voltages after transmitting negative side gradation reference voltages, before transmitting the positive side gradation reference voltages, the multiplexer-control signals are each switched to a voltage potential within the range of the ground potential to the positive power source voltage.

20. The voltage transmitting circuit according to claim 16, wherein the voltage transmitting circuit is formed as an integrated circuit on a semiconductor substrate that does not include the voltage receiving circuit.

21. A voltage receiving circuit operable to receive a transmission voltage transmitted from a voltage transmitting circuit, comprising:

a receiving terminal; and a demultiplexer comprising a positive output and a negative output;

wherein, on condition that the voltage receiving circuit receives, as the transmission voltage, at least one positive voltage higher than a ground potential, the demultiplexer outputs from the positive output the positive voltage received as the transmission voltage and outputs from the negative output the ground potential, wherein, on condition that the voltage receiving circuit receives, as the transmission voltage, a negative voltage lower than the ground potential, the demultiplexer outputs from the negative output the negative voltage received as the transmission voltage and outputs from the positive output the ground potential, wherein the demultiplexer includes a first CMOS switch connected between the receiving terminal and the positive output, and a second CMOS switch connected between the receiving terminal and the negative output, and wherein the voltage receiving circuit is configured to control well potentials of MOS transistors constituting the first and second CMOS switches with demultiplexer-control signals.

22. The voltage receiving circuit according to claim 21, further comprising:

a gradation-reference-voltage-selecting-and-supplying part;

a gradation-reference-voltage-holding-and-generating part; and a source line activation part, wherein the gradation-reference-voltage-selecting-and-supplying part is configured to selectively supply positive or negative voltages outputted by the demultiplexer to the gradation-reference-voltage-holding-and-generating part, the gradation-reference-voltage-holding-and-generating part comprises a gradation-reference-voltage-holding part including voltage-holding circuits, and is configured to hold, as gradation reference voltages, positive or negative voltages supplied from the gradation-reference-voltage-selecting-and-supplying part in the voltage-holding circuits, and produce gradation voltages based on the gradation reference voltages, and the source line activation part activates source lines of a display panel based on the gradation voltages.

23. The voltage receiving circuit according to claim 22, wherein the gradation-reference-voltage-selecting-and-supplying part is configured to sequentially supply the voltage-holding circuits with positive or negative voltages outputted by the demultiplexer, wherein the voltage-holding circuits are configured to hold the positive or negative voltages.

24. The voltage receiving circuit according to claim 23, wherein, in transmitting negative side gradation reference voltages after transmitting positive side gradation reference voltages, before transmitting the negative side gradation reference voltages, the demultiplexer-control signals are each switched to a voltage potential within the range from the negative power source voltage to the ground potential, and the demultiplexer outputs the ground potential from the positive output in response to the demultiplexer-controls signals, and wherein, in transmitting positive side gradation reference voltages after transmitting negative side gradation reference voltages, before transmitting the positive side gradation reference voltages, the demultiplexer-control signals are each switched to a voltage potential within the range from the ground potential to the positive power source voltage, and the demultiplexer outputs the ground potential from the negative output in response to the demultiplexer-control signals.

25. The voltage receiving circuit according to claim 21, wherein the voltage receiving circuit is formed on an integrated circuit.

26. The voltage receiving circuit according to claim 25, wherein the integrated circuit does not include the voltage transmitting circuit.

* * * * *